US008517503B2

(12) United States Patent
Mizoguchi et al.

(10) Patent No.: US 8,517,503 B2
(45) Date of Patent: Aug. 27, 2013

(54) INKJET PRINTING APPARATUS AND METHOD OF RECOVERING PRINTING HEAD

(75) Inventors: Yoshito Mizoguchi, Kawasaki (JP); Hiroshi Tajika, Yokohama (JP); Yuji Konno, Kawasaki (JP); Hitoshi Nishikori, Inagi (JP); Daisaku Ide, Tokyo (JP); Takeshi Yazawa, Yokohama (JP); Satoshi Seki, Kawasaki (JP); Hirokazu Yoshikawa, Kawasaki (JP); Hideaki Takamiya, Yokohama (JP); Fumiko Yano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1080 days.

(21) Appl. No.: 11/753,208

(22) Filed: May 24, 2007

(65) Prior Publication Data

US 2007/0279451 A1 Dec. 6, 2007

(30) Foreign Application Priority Data

May 31, 2006 (JP) ..... 2006-152689

(51) Int. Cl.
*B41J 2/165* (2006.01)

(52) U.S. Cl.
USPC ..... 347/23

(58) Field of Classification Search
USPC ..... 347/36
See application file for complete search history.

(56) References Cited

U.S. PATENT DOCUMENTS

| | | | | |
|---|---|---|---|---|
| 3,835,881 | A * | 9/1974 | Dal et al. | 137/389 |
| 4,130,126 | A * | 12/1978 | Chocholaty et al. | 137/3 |
| 5,699,090 | A * | 12/1997 | Wade et al. | 347/7 |
| 5,905,514 | A | 5/1999 | Rhoads et al. | |
| 5,946,007 | A * | 8/1999 | Otsuka et al. | 347/23 |
| 6,145,958 | A * | 11/2000 | Medin et al. | 347/33 |
| 6,244,685 | B1 | 6/2001 | Yamada et al. | |
| 6,637,855 | B2 | 10/2003 | Ide et al. | |
| 6,702,423 | B2 | 3/2004 | Okamura et al. | |
| 6,913,339 | B2 * | 7/2005 | Uchida et al. | 347/29 |
| 6,945,625 | B2 * | 9/2005 | Anderson | 347/19 |
| 2004/0145635 | A1 * | 7/2004 | Ebisawa et al. | 347/85 |
| 2007/0279452 | A1 | 12/2007 | Mizoguchi et al. | |

FOREIGN PATENT DOCUMENTS

| | | |
|---|---|---|
| JP | 59-045161 | 3/1984 |
| JP | 7-148934 | 6/1995 |
| JP | 10-138502 | 5/1998 |
| JP | 11-334074 | 12/1999 |
| JP | 11-342620 | 12/1999 |
| JP | 2002-166560 | 6/2002 |

* cited by examiner

*Primary Examiner* — Matthew Luu
*Assistant Examiner* — Alejandro Valencia
(74) *Attorney, Agent, or Firm* — Fitzpatrick, Cella, Harper & Scinto

(57) ABSTRACT

An object of the present invention is to appropriately dispense treatment fluid to wipers, and to always wipe ejection-orifice formation surfaces in a favorable state regardless of an environmental change and the like. To this end, in the present invention, a treatment-fluid holding portion holds treatment fluid used in a wiping operation of wipers. When the wipers contact the treatment-fluid holding portion, the treatment fluid is transferred to the wipers. In an environment where the treatment fluid is thickened, the wipers with ink dispensed thereto are brought into contact with the treatment-fluid holding portion to supply ink to the treatment-fluid holding portion. Thus, the viscosity of the treatment fluid near a contact portion between the treatment-fluid holding portion and the wipers decreases, and the treatment fluid is sufficiently transferred to the wipers.

7 Claims, 13 Drawing Sheets

INKJET PRINTING APPARATUS AND METHOD OF RECOVERING PRINTING HEAD

BACKGROUND OF THE INVENTION

1. Field of the Invention

The present invention relates to an inkjet printing apparatus in which an ejection-orifice formation surface of a printing head including ejection orifices for ejecting ink is wiped with a wiper, and relates to a method of recovering the printing head.

2. Description of the Related Art

Printing apparatuses for printing images (including characters, symbols and the like) on printing materials (printing media) such as paper, cloth, plastic sheets and transparencies are currently used in various apparatuses. For example, such apparatuses are used in various applications, such as printing apparatuses used in printers, copiers, facsimiles and the like; or printing apparatuses used as output devices for composite electronic instruments, including computers and word processors, work stations and the like.

As techniques for printing with printing apparatuses, inkjet printing, wire dot matrix printing, thermal transfer printing, electrophotographic printing and the like are generally used. Among apparatuses using any of these techniques, apparatuses using the inkjet printing technique are configured to perform printing by ejecting ink from printing heads onto a printing medium on the basis of printing information previously created. These inkjet printing apparatuses have the following various advantages. Specifically, the apparatuses can be easily made compact; high-definition images can be printed at a high speed; printing can be performed directly on plain paper and the like, without performing special treatment; running costs are low; and noise during printing is low. Furthermore, the inkjet printing apparatuses are superior in color image printing because the inkjet printing apparatuses easily perform color image printing by using many kinds of inks (e.g., color inks).

As inkjet printing heads (hereinafter simply referred to as printing heads) used in such inkjet printing apparatuses, the following inkjet printing heads, each with a different form of ejection energy generating means which ejects ink from an ejection orifice, are known. Specifically, such printing heads include those using electromechanical transducers such as piezoelectric elements, those which heat ink by applying electromagnetic waves such as laser light, and which then eject ink droplets by the heat generating effect, those which heat liquid by using electrothermal transducers such as heat elements, and the like. Among these printing heads, inkjet printing heads which eject ink as droplets by utilizing heat energy make it possible to densely arrange printing elements including ink-ejection orifices, liquid paths communicating with the ink-ejection orifices, the above-described electrothermal transducers provided to the liquid paths, and the like. Accordingly, high-resolution printing can be performed. In particular, since the recent IC technology and the micromachining technology can be utilized for printing heads which use electrothermal transducers as energy generating elements, printing heads can be easily mounted with a high density, and manufacturing costs can be made low.

An inkjet printing apparatus performs printing by ejecting ink from printing heads while a printing medium and the printing heads are moved relative to each other. According to the way in which the printing medium and the printing heads are moved relative to each other, inkjet printing apparatuses are broadly categorized as those employing serial printing, or those employing line printing. Serial printing is a method in which printing is performed while printing heads are moved in a main scanning direction transverse to the transporting direction of a printing medium. On the other hand, line printing is a method in which long printing heads having widths not less than the maximum width of an applicable printing medium are placed, and in which printing is performed while a printing medium is conveyed in a direction perpendicular to the longitudinal direction of the printing heads.

As described above, there are various printing elements and printing methods for inkjet printing apparatuses. However, in order to maintain favorable ink ejection performance in any inkjet printing apparatuses, it is necessary to always maintain ink in nozzles to be in a state suitable for ejection, and to clean portions around ejection orifices. Specifically, there are cases where ink in the vicinities of ejection orifices of printing heads dries, and then is thickened, solidified and deposited. Furthermore, there are cases where bubbles, waste and the like enter the insides of the ejection orifices (liquid paths). These are factors which cause the clogging of ejection orifices. One method of recovering (preventing, eliminating and the like) this clogging is a recovery method in which ink is forcefully expelled from ejection orifices. Recovery methods of this kind include, for example, a suction recovery method in which a sealing system is formed in an ink ejection orifice portion by using a capping member linked to a pump, and in which ink is then forcefully expelled from ejection orifices by generating, with the pump, predetermined negative suctioning force at an ejection orifice surface (a head surface). Another such method is a pressurized recovery method in which positive pressure is applied to the insides of printing heads to forcefully expel thickened ink generated in nozzles, from ejection orifices. Furthermore, the following pre-ejection is also performed as a recovery operation. Specifically, in the pre-ejection, ink not contributing to printing is ejected to the aforementioned cap or to a predetermined ink-receiving portion before and after a printing operation, or before and after each scanning operation of printing heads.

Moreover, in addition to the above-described recovery operation in which ink is ejected or expelled from printing heads, a so-called wiping recovery operation, in which cleaning is performed by wiping foreign substances adhering to the ejection-orifice formation surfaces of printing heads, is also performed as a recovery operation essential for maintaining the ejection performance of printing heads. Specifically, there are cases where foreign substances such as ink, waste, dust and paper powder adhere to the ejection-orifice formation surfaces of printing heads. There are also cases where ink adheres to the ejection-orifice formation surfaces of the printing heads after a recovery operation in which ink is expelled and ejected. When an ejection operation is performed in such a state that ink and foreign substances adhere to the ejection-orifice formation surfaces, the ejecting directions of ink droplets are deviated, and this causes deterioration in image quality. Accordingly, in inkjet printing apparatuses, a wiping recovery operation has been heretofore performed, in which ejection-orifice formation surfaces are cleaned by causing wipers of a rubber-like elastic member or the like to wipe foreign substances by rubbing the ejection-orifice formation surfaces.

However, this wiping recovery operation has the following problems. Specifically, depending on a kind or the like of employed ink, a sufficient cleaning state cannot be obtained, and the wettability of ejection-orifice formation surfaces is made uneven. These problems are significant particularly in a case where pigmented ink is used.

To be more precise, pigmented ink is more prone to thicken or solidify on ejection-orifice formation surfaces than dye ink since pigmented ink thickens or solidifies in a shorter time than dye ink, although the pigmented ink is superior in weather resistance to dye ink since the degree of fading of color materials for pigmented ink is low even when affected by light or ozone. Because of the above disadvantage, the cleaned states of ejection-orifice formation surfaces when wiped with wipers tend to be worse in a case where pigmented ink is used than those in a case where dye ink is used. In other words, even if the ejection-orifice formation surface of a printing head is rubbed with a wiper to be cleaned, ink is deposited as a thin film on the head surface, and is then solidified in a short time. Thus, there is a problem that the printing head cannot be sufficiently recovered.

Pigmented ink is formed by allowing pigment particles to self-disperse in an aqueous solution by causing the pigment particles to adsorb resin, an activator and the like to provide hydrophilicity to the pigment particles which are originally hydrophobic, or by introducing hydrophilic groups into ends of the structures of the pigment particles. For this reason, a solidified pigmented-ink substance formed by the evaporation of water in the ink on an ejection-orifice formation surface deteriorates surface properties of the ejection-orifice formation surface more than a substance formed by the solidification of dye ink in which color materials are dissolved at the molecular level. As a result, the wettability of the ejection-orifice formation surface increases in some cases. In this case, the wettability of the ejection-orifice formation surface is uneven. In particular, in so-called resin-dispersing pigmented ink in which pigments are dispersed in an aqueous solution by using resin, the resin is prone to be adsorbed by an ejection-orifice formation surface. For this reason, the resin, in addition to pigment particles, partially increases the wettability of the ejection orifice surface. Thus, unevenness in wettability is more significant. Moreover, pigment particles have particle sizes of approximately 100 nm, and are much larger than dye molecules. Accordingly, if a wiper performs a wiping operation in a state in which pigment particles exist on an ejection-orifice formation surface, the ejection-orifice formation surface is scraped by the pigment particles, and surface properties are deteriorated in some cases. This is also a factor which makes the wettability of the ejection-orifice formation surface uneven.

In a case where the wettability of an ejection orifice surface is uneven as described above, the directions of ink droplets ejected from ejection orifices are made unstable, and the accuracy of the positions in which ink droplets land on a printing medium is decreased. This results in a significant deterioration in image quality.

To solve the above-described problem, ejecting directions are stabilized also by performing a so-called water-repellent treatment on the ejection orifice surface of a printing head to cause the ejection orifice surface to repel pigmented ink. This water-repellent treatment has an effect of stabilizing ejecting directions in an early phase of use. However, in a case where spreadable ink such as pigmented ink is used, water repellency is gradually deteriorated, and thereby ejecting directions are made unstable. Moreover, if an ejection-orifice formation surface is wiped with a wiper as described previously, spreadable pigmented ink is spread on the ejection orifice surface, and this also deteriorates water repellency. For this reason, it has been difficult to maintain the effectiveness of water-repellent treatment for a long period of time.

Moreover, a proposed printing head for pigmented ink as that described in Japanese Patent Laid-open No. Hei 11-334074, is a printing head in which only portions around ejection orifices are made hydrophilic from the beginning, to make the wettability of the portions around the ejection orifices even, and to thereby stabilize the ejecting directions of ink droplets.

However, since this hydrophilicity also deteriorates with time, it is difficult to maintain favorable ejection performance for a long period of time. Currently, known treatments for providing hydrophilicity include, for example, a UV ozone treatment. However, even with such a treatment, the degree of hydrophilicity deteriorates with time, even though hydrophilicity is shown immediately after the start of use.

In view of such a change in the water repellency or the hydrophilicity of an ejection-orifice formation surface, recovery technology called wet wiping, such as that described in Japanese Patent Laid-open No. Hei 10-138502 is disclosed. In this recovery technology, solvent (hereinafter referred to as wet fluid) with a very low volatility, e.g., glycerin or polyethylene glycol, is dispensed to a wiper for wiping an ejection-orifice formation surface, and the wiper then wipes the ejection-orifice formation surface. Thus, a change in wettability is prevented. Wet fluid is dispersed to this wiper by bringing the wiper into contact with a sponge-like wet-fluid holding portion immersed in wet fluid, and then by transferring the wet fluid held in the wet-fluid holding portion to the wiper.

This wet fluid has the following three effects. The first one is an effect of dissolving thickened or solidified ink accumulated on the ejection-orifice formation surface. The second one is an effect of a lubricant generated by being interposed between the wiper and the ejection-orifice formation surface. The third one is an effect of forming a film which protects the ejection-orifice formation surface by being dispensed to the ejection-orifice formation surface by the wiper.

However, a study done by the present inventors, on a change in a state of the ejection-orifice formation surface of a printing head with the above-described wet wiping being employed, has revealed that wet wiping is less effective in a low-temperature environment, and that the state of the ejection-orifice formation surface changes from the initial state. This change decreases the accuracy with which ejected liquid droplets land, and thereby deteriorates the quality of a printed image.

A study on the behavior of wet fluid in such a low-temperature environment has revealed that the amount of wet fluid transferred to a wiper greatly varies depending on temperature environments. That is, as the temperature of the environment where wet fluid is used decreases, the amount of wet fluid transferred to the wiper decreases. Wet fluid is supposed to be originally held continuously in a printing apparatus body for the lifetime of the apparatus body. Accordingly, wet fluid having a low saturation vapor pressure in the air, i.e., wet fluid which does not evaporate quickly, is favorable. In consideration of the solubility of thickened ink and that of solidified ink, and contact properties of the ink on each component of the printing head, a polyhydric alcohol, such as glycerin or polyethylene glycol often used as an ink composition for inkjet printing apparatuses, is preferably used. Since many of these solvents generally have high molecular weight and high viscosity, the viscosity thereof greatly increases in low-temperature environments.

FIG. 13 shows a temperature-viscosity curve for glycerin as one example. The viscosity, which is approximately 800 cp at room temperature, increases to 2300 cp at 15° C., and to 7000 cp at 5° C. In short, the viscosity drastically increases as temperature decreases.

Such an increase (thickening) in the viscosity of wet fluid in a low-temperature environment decreases the amount of wet fluid transferred from a wet-fluid holding portion to the wiper. This is considered to be caused due to the following phenomenon. That is, in a case where the wiper is in contact with the wet-fluid holding portion in a state in which wet fluid is thickened, the wet fluid and the wiper do not sufficiently come in contact with each other. Another conceivable factor is that the viscous wet fluid is difficult to leave the wet-fluid holding portion to attach to the wiper when the wiper is removed from the wet-fluid holding portion.

In contrast, the following technology is also proposed. Without using the above-described treatment fluid only for wiping, a wiper is wetted with ink by ejecting liquid (ink) from ejection orifices when the wiper moves past the ejection orifices of a printing head, and then the wet wiper wipes the ejection-orifice formation surface. In order to distinguish wiping performed by ejecting ink to a wiper from the aforementioned "wet wiping" performed by ejecting wet fluid to a wiper, wiping performed by ejecting ink to a wiper is hereinafter referred to as "ink wet wiping".

Apparatuses which perform such wet wiping include, for example, those disclosed in Japanese Patent Laid-open Nos. Sho 59-45161, Hei 07-148934 and Hei 11-342620. Specifically, Japanese Patent Laid-Open No. Sho 59-45161 discloses a technology in which, when the ejection-orifice formation surface of a printing head is wiped along the arranging direction of ejection orifices, wiping is performed while ink is ejected to a wiper from ejection orifices which are formed at the upstream side in the wiping direction, and which does not contribute to image formation. Another disclosed wet wiping is performed while ink is ejected from not only ejection orifices not contributing to image formation, but also ejection orifices used for the image formation.

Japanese Patent Laid-Open No. Hei 07-148934 discloses a technology in which stains are removed with the wet wiper after ink is ejected to a wiper to wet the wiper. Japanese Patent Laid-Open No. Hei 11-342620 discloses a technology in which stain removal performance is improved by also using ink ejection when an ejection-orifice formation surface in which a plurality of ejection orifices are formed is wiped in a direction perpendicular to the arranging direction of the ejection orifices.

However, in these ink wet wiping techniques, pre-ejection of a large amount of ink is performed in regions in addition to a region in which a wiper comes in contact with an ejection-orifice formation surface. This is a factor for excessively soiling the inside of a printing apparatus body, and for generating a large amount of mist. These techniques also have disadvantages, such as unnecessary consumption of ink.

In view of such problems, Japanese Patent Laid-open No. 2002-166560 discloses a technique in which a wiper is wetted while ink is ejected sequentially from ejection orifices (ejection orifices at the downstream side in the wiping direction) which are about to be wiped. This makes it possible to perform wiping while ink consumption is reduced, and to reduce stains made by ink in the vicinity of a wiping device, as compared to techniques disclosed in Japanese Patent Laid-Open Nos. Hei 07-148934 and Hei 11-342620.

However, Japanese Patent Laid-Open No. 2002-166560 discloses ink wet wiping performed in all wiping operations, and this reduces the number of paper sheets that a printing apparatus can handle. This technology reduces stains made by ink in the vicinities of wipers and a wiping device, as compared to those described in Japanese Patent Laid-Open No. Hei 07/148934 and Japanese Patent Application Laid-Open No. Hei 11-342620. However, stain prevention with the technique disclosed in Japanese Patent Laid-Open No. 2002-166560 is still insufficient. That is, performing ink wet wiping in all wiping operations results in portions in the vicinity of the wiping device being stained with ink. Furthermore, since ink dispensed to the wipers evaporates and thickens, there is apprehension that wiping capability may deteriorate in the next wiping. In addition, a wiping operation may be inhibited by the evaporation, thickening and the like of ink adhering to portions in the vicinity of a movable portion of the wiping device.

As described above, an inkjet printing apparatus for which wet wiping is employed has the problem that the amount of wet fluid transferred to wipers greatly varies depending on the environment where the printing apparatus is used. Specifically, the amount of wet fluid transferred from a wet-fluid holding portion to the wipers is less in a low-temperature environment than that at room-temperature because the viscosity of wet fluid increases in the low-temperature environment. This leads to a problem that favorable image quality cannot be obtained because the wet wiping, which is not as effective as the initial wet wiping, deteriorates the ink-droplets ejection performance of each ejection orifice.

Furthermore, an inkjet printer in which ink wet wiping is used as described above has the problems that wipers and a wiping device are stained, and that ink adhering thereto evaporates and thickens to deteriorate the wiping performance of the wipers and of the wiping device.

SUMMARY OF THE INVENTION

An object of the present invention is to provide an inkjet printing apparatus in which treatment fluid can be appropriately dispensed to a wiper without being affected by an environment, and in which an ejection-orifice formation surface can be wiped in a favorable state. Another object of the present invention is to provide a method of recovering a printing head.

In order to achieve the above-described objects, the present invention has the following configuration.

A first aspect of the present invention is an inkjet printing apparatus including a wiper for wiping an ejection-orifice formation surface of a printing head in which an ink-ejection orifice is formed. The inkjet printing apparatus includes a treatment-fluid holding portion and ink supplying means. The treatment-fluid holding portion holds treatment fluid used in a wiping operation of the wiper, and includes a transferring portion for transferring the treatment fluid to the wiper by being in contact with the wiper. The ink supplying means supplies ink to the transferring portion by way of the wiper.

A second aspect of the present invention is a method of recovering a printing head, in which an ejection-orifice formation surface of the printing head with an ink-ejection orifice formed therein is wiped by a wiper to recover ejection performance of the ejection orifice. The method includes the steps of bringing the wiper into contact with a treatment-fluid holding portion which holds treatment fluid used in a wiping operation of the wiper to transfer the treatment fluid to the wiper; and supplying ink to the transferring portion through the wiper.

According to the present invention, even in a case where the viscosity of the treatment fluid held in the treatment-fluid holding portion increases due to an environmental change, the viscosity of the treatment fluid can be decreased by supplying ink ejected from the printing head to the treatment-fluid holding portion by way of the wiper. As a result, regardless of an environmental change, the ejection-orifice formation surface of the printing head can be always wiped with sufficient treatment fluid being transferred to the wiper. Thus, the ejection-orifice formation surface can be maintained in a favorable state suitable for ejection.

Moreover, ink may be supplied to the treatment-fluid holding portion only in an environment where the viscosity of the treatment fluid increases, such as a low-temperature environment, a low-humidity environment or the like. Accordingly, stains on the apparatus due to a transfer operation by way of the wiper can be reduced to the minimum.

Further features of the present invention will become apparent from the following description of exemplary embodiments with reference to the attached drawings.

DESCRIPTION OF THE EMBODIMENTS

Hereinafter, embodiments of the present invention will be described with reference to the drawings.

First Embodiment

1. Overview of Inkjet Printing Apparatus

Figure 1:
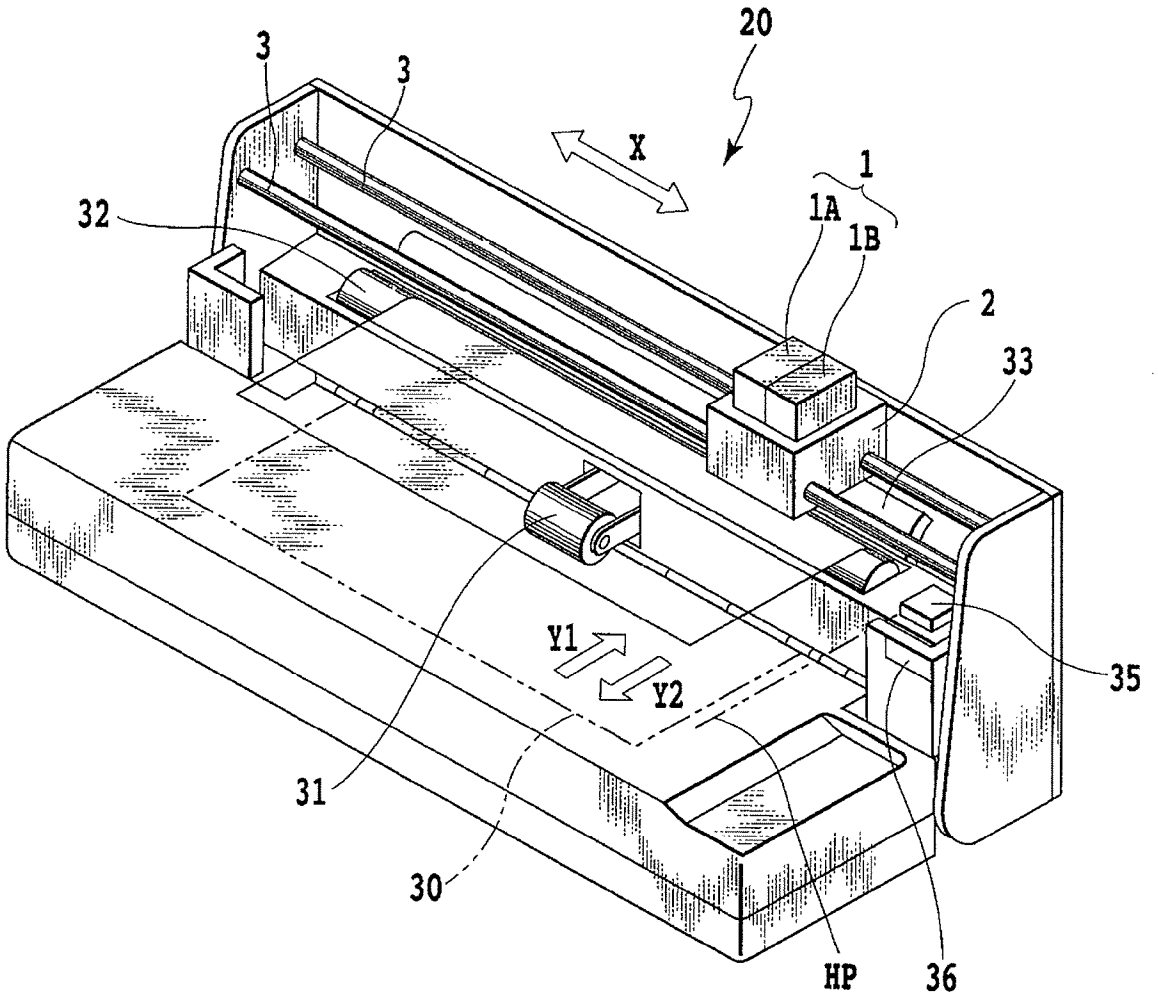
FIG. 1 is a perspective view showing a schematic configuration of an inkjet printing apparatus in an embodiment of the present invention.

FIG. 1 is a perspective view showing a schematic configuration of a principal part of an inkjet printing apparatus provided with an inkjet printing head recovery device of the present invention.

Figure 4:
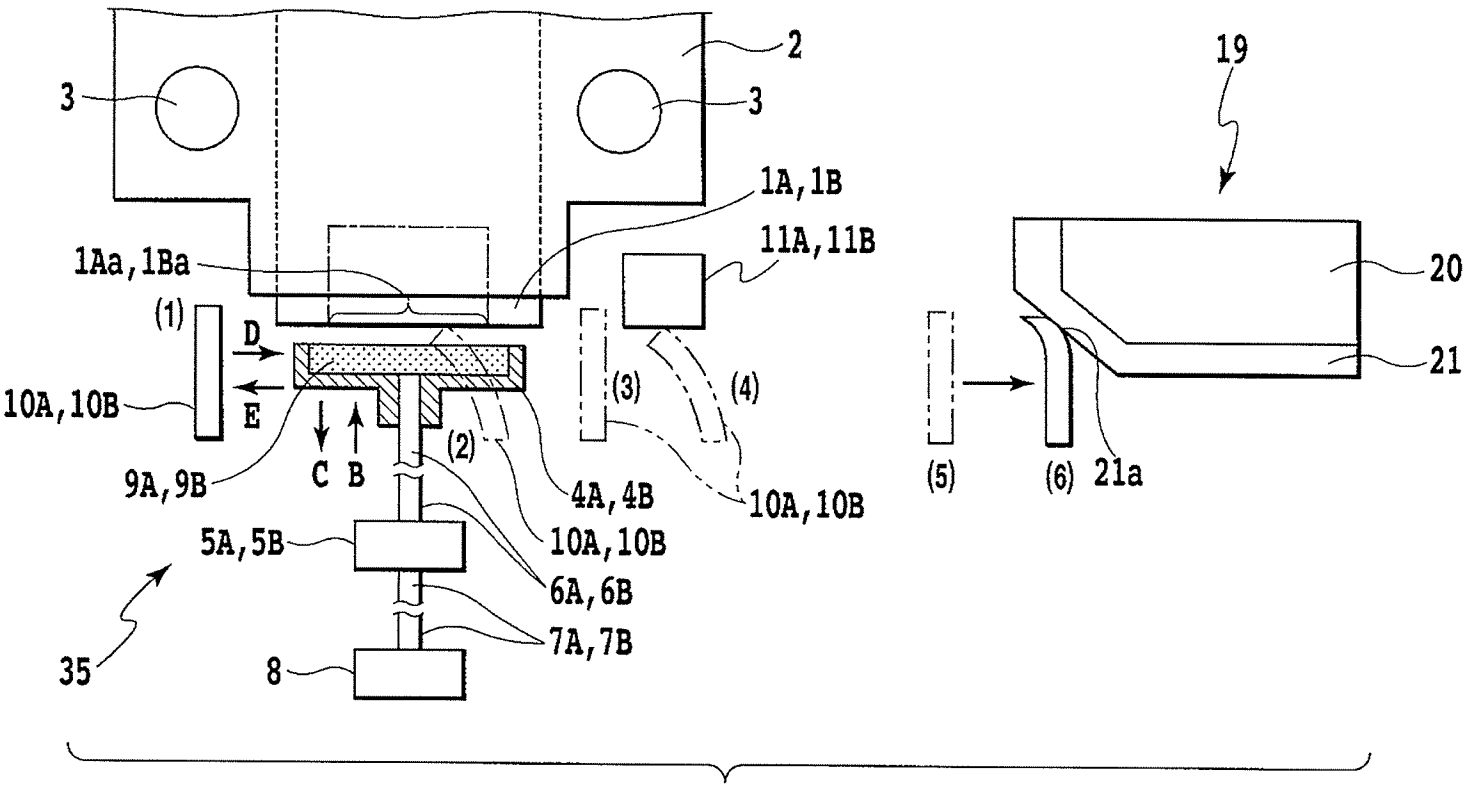
FIG. 4 is a side view showing the recovery device shown in FIG. 2, showing a print-ready state.
Figure 5:
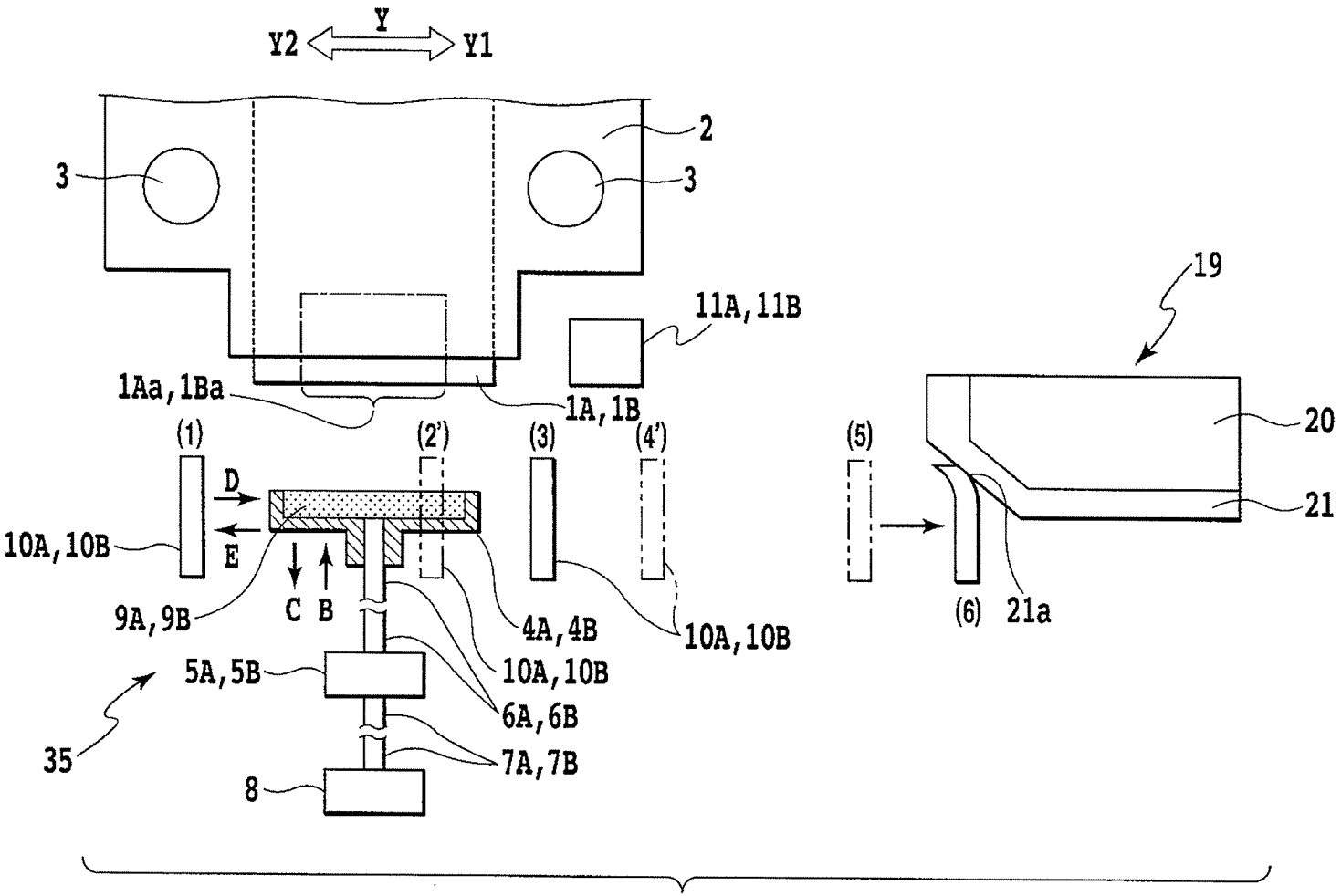
FIG. 5 is a side view showing the recovery device shown in FIG. 2, showing a state in which wetting pre-ejection is performed.

The inkjet printing apparatus 20 shown in FIG. 1 is an inkjet printing apparatus (hereinafter simply referred to as a printing apparatus) which performs serial printing, and in which a carriage 2 is guided by guide shafts 3, to be movable along a main scanning direction (a X-direction in FIG. 1). The carriage 2 is reciprocated by driving force of a carriage motor and that of a belt to which the driving force of the carriage is transferred. This carriage 2 is configured so that the carriage 2 can be moved up and down with the guide shafts 3 by an unillustrated lifting mechanism. FIG. 5 shows a state in which the carriage 2 is lifted up, and FIG. 4 shows a state in which the carriage 2 is lowered.

On this carriage 2, printing heads 1 and ink tanks for supplying ink to the printing heads 1 are mounted in a way that the ink tanks can be switched. The printing heads 1 and the ink tanks may constitute inkjet cartridges. Moreover, the printing heads 1 used in this embodiment include a printing head (hereinafter also referred to as a black head) 1A for ejecting black ink, and printing heads (hereinafter also referred to as color heads) 1B for ejecting color inks. In this embodiment, as the black ink, used is matte black pigmented ink of a so-called surface coating type which is suitable for plain paper, matte paper and the like, and which has a high surface tension. This black ink is self-dispersing ink in which hydrophilic groups are introduced into the structures of pigment particles at ends thereof to allow the pigment particles to self-disperse in an aqueous solution. On the other hand, as the color inks, used are color pigmented inks of a so-called penetrating type which is suitable for inkjet glossy paper, photographic paper and the like, and which has a low surface tension. In this embodiment, the color inks include four colors: black, cyan, magenta and yellow. For each color, a printing head is provided. These color inks are inks in which pigment particles are dispersed in water using resin having a surface-active-agent-like function. Incidentally, these color pigmented inks are also referred to as resin pigmented inks.

In this embodiment, inkjet printing heads which eject ink by utilizing heat energy are used as the printing heads 1A and 1B. Each of the printing heads 1A and 1B has a surface (ejection-orifice formation surface) which faces a printing medium, and in which one or more columns of many ejection orifices for ejecting ink are formed. An electrothermal transducer for converting electric energy into heat energy is provided to each of liquid paths communicating with the respective ejection orifices. The ejection orifices of the printing heads 1A and 1B are formed in a way that, in a state in which the printing heads 1A and 1B are mounted on the carriage, the ejection orifices thereof are arranged along a sub scanning direction (a Y-direction in FIG. 1) perpendicular to the main scanning direction (X-direction in FIG. 1), which is the moving direction of the carriage 2. Each of the printing heads 1A and 1B is a so-called water-repellent head in which the ejection-orifice formation surface thereof is coated with a water repellent.

Each of the electrothermal transducers of the printing heads is energized and heated in response to a driving signal generated according to print data. The heat energy generated in the electrothermal transducer causes the film boiling in ink supplied to the liquid path. By utilizing a pressure change due to the growth and shrinkage of a bubble generated at this time, ink is ejected from the ejection orifice. It should be noted that, in the description below, a portion including the ejection orifice, the liquid path and the electrothermal transducer is referred to as a nozzle. Moreover, in a moving range of the carriage 2, a home position HP of the carriage 2 is set in a position (in a right end portion in FIG. 1) outside the printing zone. To this home position HP, an undermentioned recovery device 35 for maintaining the ejecting performance of the nozzles of the printing heads is provided. Furthermore, in the vicinity of the recovery device 35, a temperature sensor 36 is provided to a side plate of a body portion of the printing apparatus. In this embodiment, a thermistor is used as the temperature sensor.

In the above-described inkjet printing apparatus, a printing medium P is fed, by a feed roller 31, from a printing medium containing portion provided to a front end portion of the apparatus into the body of the printing apparatus along the sub scanning direction Y1. Then, the printing medium P is held on a conveyance roller 32, with a pinch roller (not shown) and a paper support plate 33, and intermittently conveyed by the rotation of the conveyer roller 32 in the transporting direction Y2 opposite to the feeding direction. This conveyance operation moves the printing medium P past the lower surfaces (ejection-orifice formation surfaces) of the black and color heads 1A and 1B with a predetermined space maintained therebetween. When the printing medium P is stationary, the carriage 2 and the printing heads move in the main scanning direction (the X-direction) along the guide shafts 3. At this time, the electrothermal transducers of the printing heads 1A and 1B are driven, and then ink is ejected. Thereby, the ejected ink lands on the printing medium P. As a result, printing having a width corresponding to the arranging width of the ejection orifices of the printing heads is performed on the printing medium P. In this way, a printing operation performed by ejecting ink while moving the printing heads in the main scanning direction, and a conveyance operation performed by conveying the paper P in the sub scanning direction by a distance corresponding to the printing width, are repeatedly performed. Thus, an image (including characters, symbols and the like) is formed on the printing medium P.

2. Recovery Device

Figure 2:
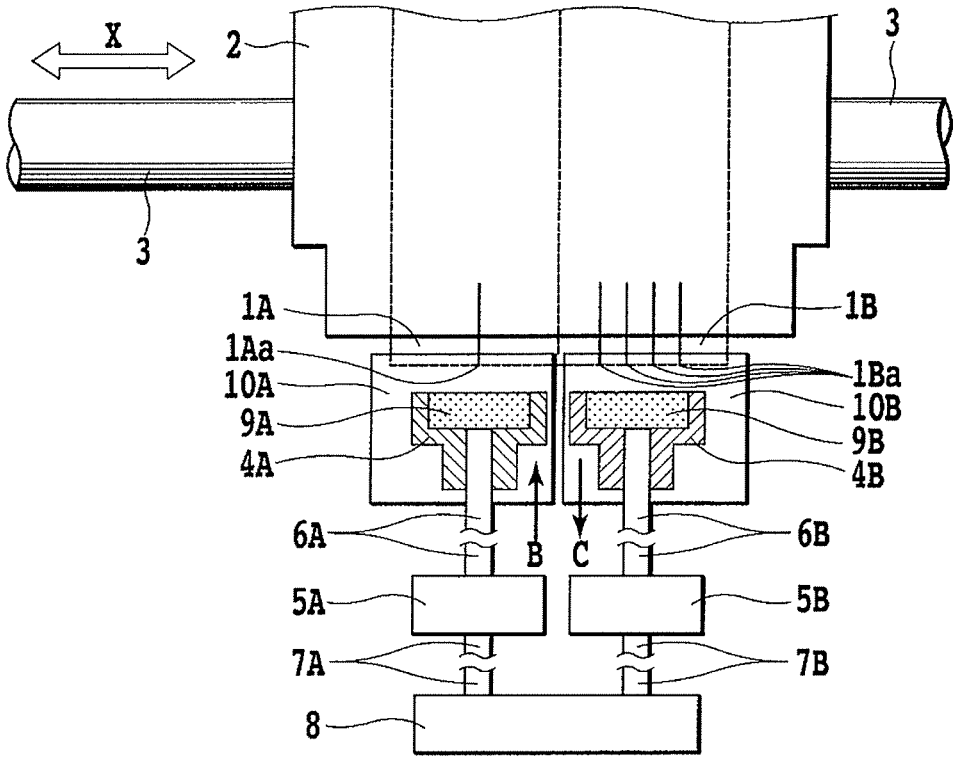
FIG. 2 is a front view showing a recovery device in a first embodiment of the present invention.
Figure 3:
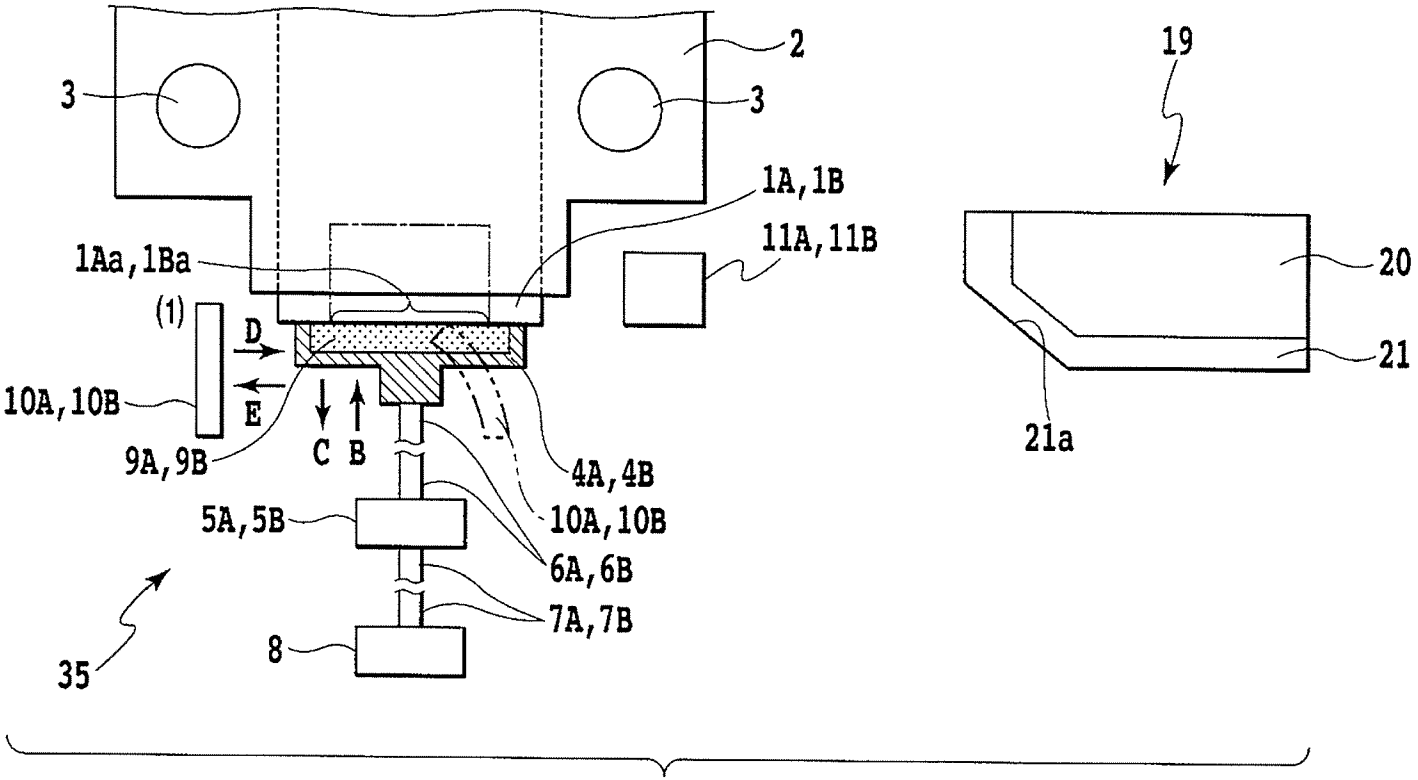
FIG. 3 is a side view showing the recovery device shown in FIG. 2, showing a capping state.

FIGS. 2 to 5 are views showing the recovery device 35 provided to the inkjet printing apparatus of this embodiment. FIG. 2 is a front view, and FIGS. 3 to 5 are side views.

The recovery device 35 includes suctioning means which suctions ink in the nozzles of the printing heads from the ejection orifices, cleaning means which wipes, with wipers, foreign substances such as ink and dust adhering to the ejection-orifice formation surfaces, and a wet-fluid holding portion (treatment-fluid holding portion) which holds wet fluid (treatment fluid) to be supplied to the wipers.

Here, the suctioning means will be described first.

The suctioning means is provided with a capping mechanism and suction pumps 5A and 5B. The capping mechanism includes caps 4A and 4B which are made of a rubber-like elastic material, and which can seal the ejection orifices by tightly adhering to the ejection-orifice formation surfaces of the black and color heads 1A and 1B. The suction pumps 5A and 5B communicate with the caps.

The capping means includes a cap (hereinafter also referred to as a black cap) 4A which can seal ejection orifices 1A*a* by tightly adhering to the ejection-orifice formation surface of the black head 1A. The capping means further includes a cap (hereinafter also referred to as a color cap) 4B which can seal ejection orifice portions 1Ba of the color heads 1B. Inside the caps 4A and 4B, ink-absorbing members 9A and 9B for absorbing and holding ink are provided. The caps 4A and 4B are held with an unillustrated cap-moving mechanism in a way that the caps 4A and 4B can move in a capping direction (direction of arrow B) and an uncapping direction (a direction of arrow C). This cap-moving means and the caps 4A and 4B constitute the capping means. Note that, in the description below, capping refers to an operation in which the caps 4A and 4B tightly adhere to the ejection-orifice formation surfaces to seal the ejection orifice portions 1A*a* and 1B*a*, respectively.

The suction pump 5A is a suction pump (suctioning means) which suctions black ink and which communicates with the cap 4A through a first tube 6A, and the suction pump 5B is a suction pump (suctioning means) which suctions color inks, and which communicates with the cap 4B through a first tube 6B. The suction pumps 5A and 5B are coupled to a waste ink processing member 8 through second tubes 7A and 7B, respectively. When the suction pumps 5A and 5B are driven in a state where the caps 4A and 4B cap the ejection-orifice formation surfaces, predetermined suction pressures (negative pressures) are generated in the caps 4A and 4B, and the negative pressures force ink to be suctioned from the ejection orifice portions 1Aa and 1Ba. The suctioned ink is expelled into the waste ink processing member 8 through the first tubes 6A and 6B, the pumps 5A and 5B and the second tubes 7A and 7B. The forgoing is a suction recovery operation. This suction recovery operation removes thickened ink, bubbles, dust and the like from the insides of the nozzles of the printing heads, and instead, fills the nozzles with ink which is supplied from the ink tanks, and which is in a state suitable for ejection.

Next, the cleaning means will be described.

This cleaning means includes wipers 10A and 10B which rub the ejection-orifice formation surfaces of the black and color heads 1A and 1B to wipe foreign substances such as ink and dust. The wiper 10A is a wiper for the black head, and the wiper 10B is a wiper for the color heads. These wipers can be formed of rubber members made of urethane, butyl, silicone or the like; porous sponge-based members; or the like. In this embodiment, polyether urethane is used for the wipers 10A and 10B.

The wipers 10A and 10B can be moved by an unillustrated wiper-moving mechanism in the direction (a forward direction) indicated by arrow D and the direction (a backward direction) indicated by arrow E in FIG. 3. That is, the wipers 10A and 10B reciprocate in the range of a waiting position denoted by (1) in FIG. 3 to a wet-fluid holding portion 19 described later. Note that the directions indicated by arrows D and E are directions parallel to the conveyance directions (the Y1- and Y2-directions) of a printing medium, which are equal to the arranging directions of the ejection orifices of the printing heads, i.e., directions perpendicular to the direction (the X-direction) in which the carriage 2 moves along the guide shafts 3.

The cleaning means further includes wiper cleaners 11A and 11B for removing foreign substances such as ink droplets, waste, dust and paper powder adhering to the wipers 10A and 10B. Each of the wiper cleaners 11A and 11B is placed between the corresponding head 1A or 1B and the wet fluid holding unit 19. Accordingly, the wipers 10A and 10B which have wiped the ejection-orifice formation surfaces pass the wiper cleaners while being in contact therewith, before reaching the wet fluid holding unit 19. Thus, foreign substances such as thickened ink adhering to the wipers 10A and 10B are transferred to the corresponding wiper cleaners 11A and 11B, and then are removed from the wipers 10A and 10B. At this time, the caps 4A and 4B of the capping means move in the direction (an upward direction in the drawing) of arrow C by an unillustrated driving source, and then are retracted to positions (not shown) where the caps 4A and 4B do not interfere with the wipers 10A and 10B.

Next, an example of a configuration of the wet-fluid holding portion will be described.

The wet-fluid holding portion 19 described here is provided in a vicinity of the returning positions (a position denoted by (6) in FIGS. 4 and 5) of the reciprocating paths of the wipers 10A and 10B. That is, the wet-fluid holding portion 19 is placed to the right of the wiper cleaners 11A and 11B (see FIGS. 3 to 5). This wet-fluid holding portion 19 includes a wet-fluid holding member 20 and a wet-fluid transferring member (transferring portion) 21 provided as being in contact with the outer surface of the wet-fluid holding member 20.

The wet-fluid holding member 20 of this embodiment is made of polypropylene fibers compression-molded into a sponge form (hereinafter referred to as a PP sponge), and is immersed in wet fluid. It is possible to appropriately select the fiber diameter of the polypropylene used as the wet-fluid holding member 20, the apparent density of the fibers in a sponge form, the alignment direction of the fibers in the sponge, the compressibility at which the sponge is incorporated into the device, and the like. The wet-fluid transferring member 21 operates so as to absorb wet fluid from the wet-fluid holding member 20 to the outer surface, and then to dispense (transfer) the wet fluid to the wipers 10A and 10B which are in contact with the outer surface. Incidentally, in FIGS. 3 to 5, 21*a* denotes a contact portion with which the wipers 10A and 10B are in contact. In this embodiment, Sunfine (trademark) AQ900 manufactured by Asahi Kasei Corporation is used as the material constituting the wet-fluid transferring member 21. Here, in order to ensure that wet fluid is supplied from the wet-fluid holding member 20 to the wet-fluid transferring member 21, the wet-fluid transferring member 21 needs to have a larger capillary force than that of the wet-fluid holding member 20. Accordingly, the average pore size, apparent density, capillary force and the like of the wet-fluid transferring member 21 need to be appropriately selected so that the above-described capillary force relationship is maintained. The wet-fluid holding member 20 is formed of any one of an absorber made of fibers and an open-cell foam.

Moreover, in this embodiment, glycerin is used as wet fluid. Glycerin itself does not evaporate quickly. However, glycerin easily absorbs moisture from the air, and has a characteristic of releasing moisture in a low-humidity environment, even after grycerin has absorbed moisture once. Accordingly, the wet-fluid holding member 20 and the wet-fluid transferring member 21 are preferably surrounded and shielded with an unillustrated material having low steam permeability so that the wet-fluid holding member 20 and the wet-fluid transferring member 21 would not be affected by moisture absorption and drying. However, it is desirable that the shielding material not completely shield the wet-fluid holding member 20 and the wet-fluid transferring member 21, but be provided with fine pores leading to the atmosphere so as to withstand the expansion and shrinkage of air existing in the wet-fluid holding member 20.

The capacity of the wet-fluid holding member 20 is found by performing an inverse calculation based on the necessary amount of wet fluid. To be more specific, the necessary amount of wet fluid is found as follows. First, the amount of wet fluid to be transferred in one wiping operation is found by an experiment or the like. Here, the obtained amount of wet fluid prevents the water-repelling states of the ejection-orifice formation surfaces from being deteriorated, and allows accuracy of the landing positions of ejected fluid droplets to be maintained in an allowable range even if wet wiping is performed a number of times corresponding to the number of paper sheets that the inkjet printing apparatus can handle. Next, the obtained value is multiplied by the number of times of wiping corresponding to the endurance number of sheets, and thereby the necessary amount of wet fluid is obtained. Then, the capacity of the wet-fluid holding member 20 is set so that the wet-fluid holding member 20 can hold the necessary amount of wet fluid.

For example, it is supposed that 1 mg of glycerin is transferred to the wipers 10A and 10B in one wet wiping operation, and that printing can be performed without problems for a target endurance number of sheets, which are 10000 sheets, by wiping, with the wipers, the ejection-orifice formation surfaces of the water-repellent heads. In this case, the amount of glycerin necessary for the number of paper sheets that the apparatus can handle is the value obtained by multiplying 1 mg by 10000, i.e., 10 g. In addition to the necessary amount of glycerin, in consideration of the density of glycerin, the amount of glycerin held in the PP sponge, the amount of glycerin held in the transferring member, the remaining amount of glycerin at the time when glycerin is used up, and the like, the necessary capacity of the glycerin-holding portion is approximately 20 cc. Depending on efficiency in using up glycerin, the amount of glycerin injected initially is at least approximately 1.2 times the necessary amount because it is not generally expected that 100% of glycerin is used up. It is a matter of course that the conditions, i.e., the amount of glycerin necessary for one wiping operation, the number of paper sheets that the apparatus can handle, the amounts of glycerin held in the PP sponge and in the wet-fluid transferring member 21, and the like, vary depending on requirements and the like of individual inkjet printing apparatuses. For this reason, these conditions should be appropriately set.

3. Configuration of Electric Circuit

Next, a configuration of an electric circuit of this embodiment will be described.

Figure 7:
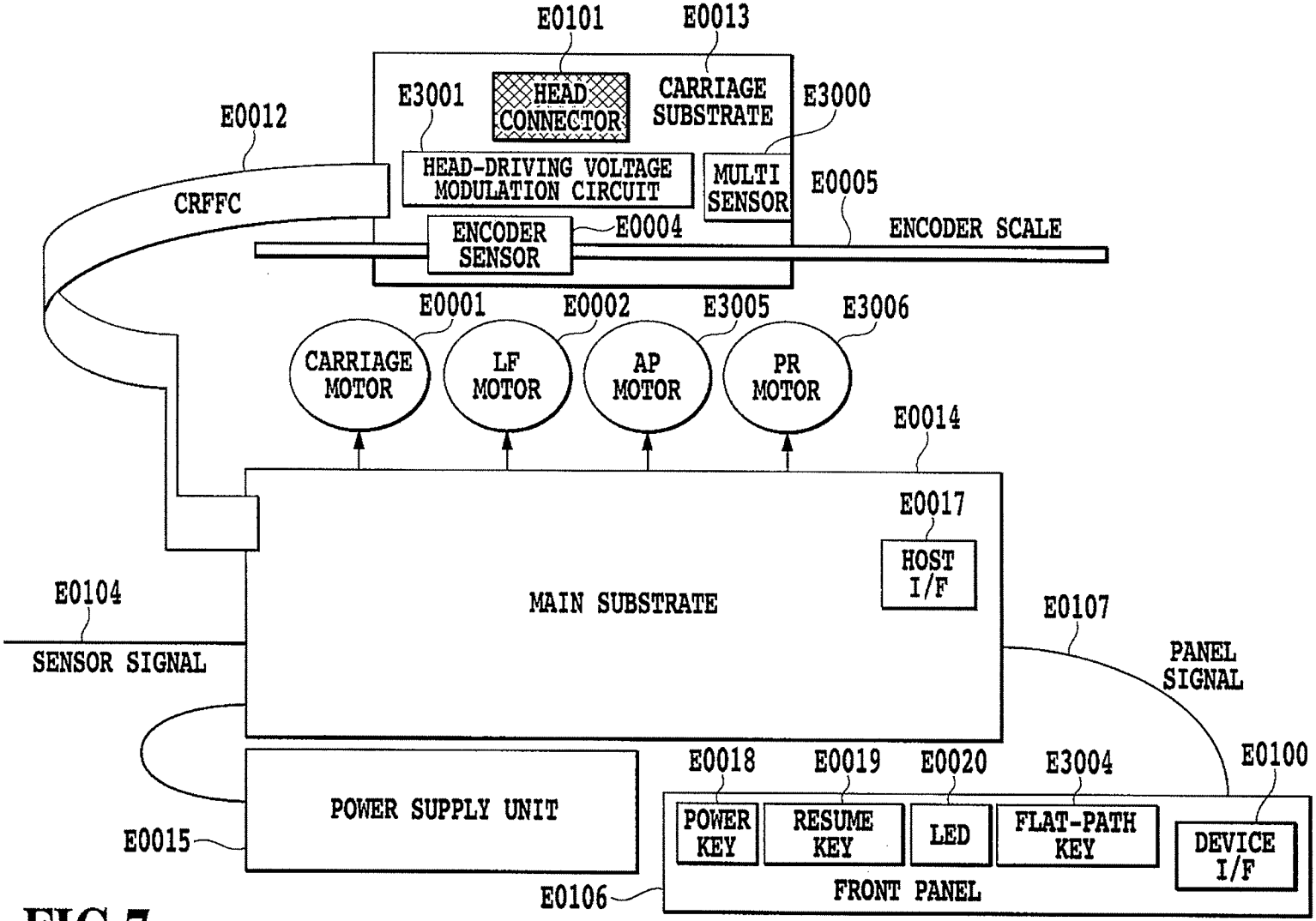
FIG. 7 is a block diagram showing a configuration of an electric circuit provided to the inkjet printing apparatus shown in FIG. 1.

FIG. 7 is a block diagram for schematically explaining an overall configuration of an electric circuit of a printing apparatus J0013. The electric circuit of the printing apparatus which is employed in this embodiment is composed primarily of a carriage substrate E0013, a main substrate E0014, a power supply unit E0015, a front panel E0106, and the like.

The power supply unit E0015 is connected to the main substrate E0014, and supplies various driving powers.

The carriage substrate E0013 is a printed circuit board unit mounted on a carriage M4000, and functions as an interface which transmits and receives signals to/from a printing head H1001 via a head connector E0101, and which supplies head-driving power. As a portion serving to control the head-driving power, a head-driving voltage modulation circuit E3001 having a plurality of channels corresponding to the respective colors of the ejection portions of a printing head H1001 is provided. The head-driving voltage modulation circuit E3001 generates a head-driving power voltage on the basis of a condition designated by the main substrate E0014 through a flexible flat cable (CRFFC) E0012. Moreover, on the basis of a pulse signal outputted from an encoder sensor E0004 in accordance with the movement of the carriage M4000, the head-driving voltage modulation circuit E3001 detects a change in the positional relationship between an encoder scale E0005 and the encoder sensor E0004. Furthermore, the head-driving voltage modulation circuit E3001 outputs the output signal to the main substrate E0014 via the flexible flat cable (CRFFC) E0012.

An optical sensor and a thermistor for detecting ambient temperature (these sensors are hereinafter collectively referred to as a "multisensor E3000") are connected to the carriage substrate E0013. Information obtained by the multisensor E3000 is outputted to the main substrate E0014 via the flexible flat cable (CRFFC) E0012.

The main substrate E0014 is a printed circuit board unit which is responsible for controlling the driving of each portion of the inkjet printing apparatus of this embodiment. The substrate includes a host interface (host I/F) E0017 to control a printing operation on the basis of data received from an unillustrated host computer. Moreover, the main substrate E0014 is connected to various motors including a carriage motor E0001, an LF motor E0002, an AP motor E3005, and a PR motor E3006 to control the driving of each function. The carriage motor E0001 is a motor which serves as a driving source for moving the carriage M4000 in the main scanning direction, and the LF motor E0002 is a motor which serves as a driving source for conveying a printing medium. The AP motor E3005 is a motor which serves as a driving source for the operation of recovering the printing head H1001 and for the operation of feeding the printing medium, and the PR motor E3006 is a motor which serves as a driving source for a flat-path printing operation. The main substrate E0014 transmits and receives, by use of a sensor signal E0104, control signals and detection signals to/from various sensors including a PE sensor, a CR lift sensor, an LF encoder sensor and a PG sensor for detecting the operating state of each portion of the printer. In addition, the main substrate E0014 is connected to each of the CRFFC E0012 and the power supply unit E0015, and includes an interface for transmitting and receiving information to/from the front panel E0106, by use of a panel signal E0107.

The front panel E0106 is a unit provided to the front of the printing apparatus body for offering operational convenience to users. The front panel E0106 includes a resume key E0019, an LED E0020, a power key E0018 and a flat-path key. The front panel E0106 further includes a device I/F E0100 used for connecting the apparatus to peripheral devices including a digital camera.

Figure 8:
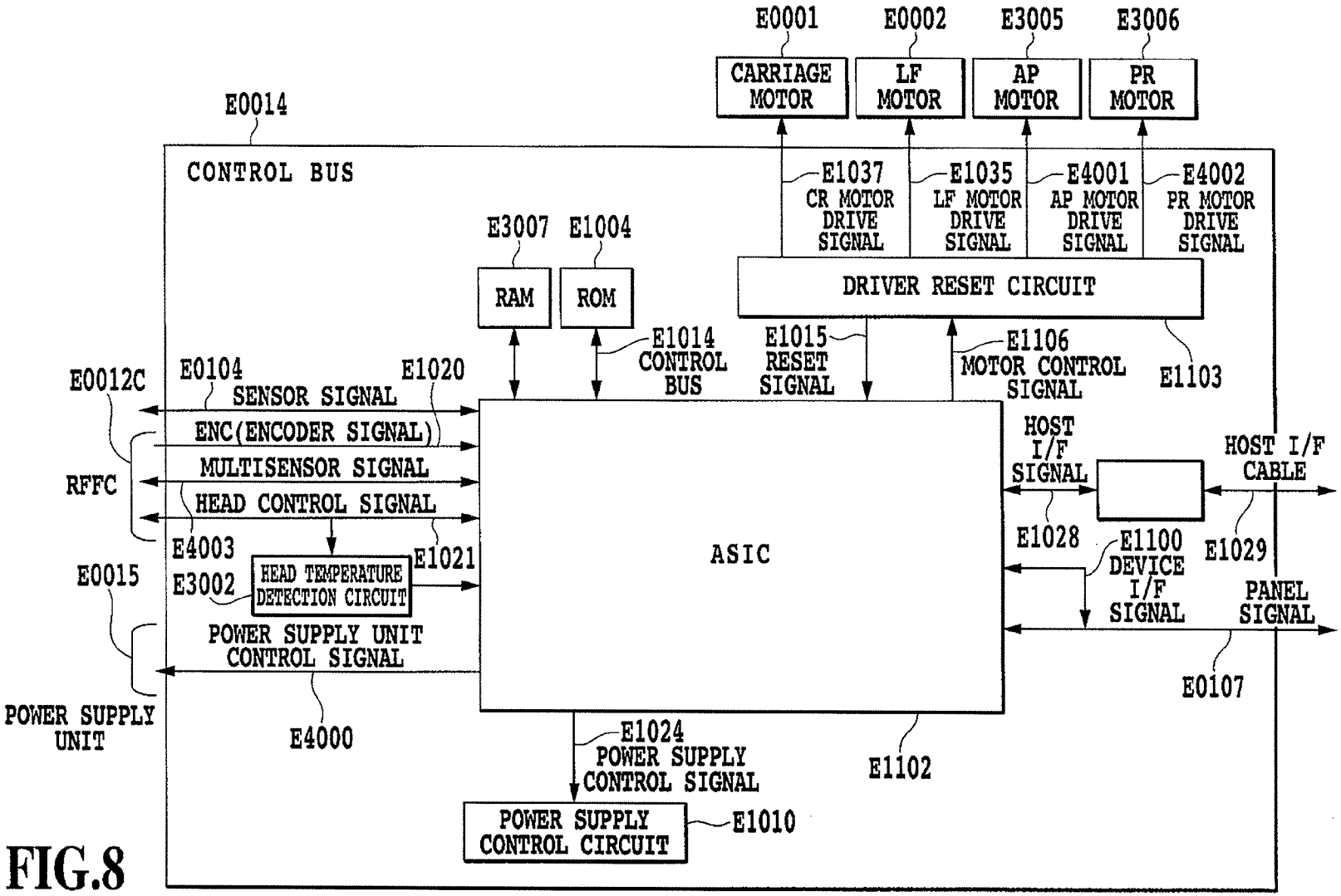
FIG. 8 is a block diagram showing an internal configuration of a main substrate shown in FIG. 7.

FIG. 8 is a block diagram showing the internal configuration of the main substrate E1004.

In FIG. 8, E1102 denotes an application specific integrated circuit (ASIC), and is connected to a ROM E1004 via a control bus E1014. The ASIC E1102 performs various kinds of control based on a program stored in the ROM E1004. For example, the ASIC E1102 transmits and receives the sensor signal E0104 relating to various sensors and a multisensor signal E4003 relating to the multi sensor E3000. Moreover, the ASIC E1102 detects an output state of an encoder signal E1020, and output states from the power key E0018, the resume key E0019 and the flat-path key E3004 on the front panel E0106. Furthermore, the ASIC E1102 performs various logical operations, condition determination, and the like, according to the connection and data input states of the host I/F E0017 and the device I/F E0100 on the front panel, and controls each component. In other words, the ASIC E1102 is responsible for controlling the driving of the inkjet printing apparatus.

E1103 denotes a driver reset circuit, which generates a CR motor drive signal E1037, an LF motor drive signal E1035, an AP motor drive signal E4001 and a PR motor drive signal E4002 based on a motor control signal E1106 from the ASIC E1102. In accordance with these drive signals, the respective motors are driven. The driver reset circuit E1103 includes a power supply circuit to supply necessary power to portions including the main substrate E0014, the carriage substrate E0013, and the front panel E0106. In addition, the carriage substrate E0013 detects a decrease in the power supply voltage to generate a reset signal E1015, and perform initialization.

E1010 denotes a power supply control circuit, which controls power supply to each sensor or the like including a light-emitting device on the basis of a power supply control signal E1024 from the ASIC E1102. The host I/F E0017 transmits a host I/F signal E1028 from the ASIC E1102 to a host I/F cable E1029 connected to the outside, and transmits a signal from this cable E1029 to the ASIC E1102.

On the other hand, power is supplied from the power supply unit E0015. The supplied power is then supplied to each portion inside or outside the main substrate E0014 after the voltage thereof is converted if necessary. By inputting a power supply unit control signal E4000 from the ASIC E1102 to the power supply unit E0015, a low power consumption mode or the like of the printing apparatus body is controlled.

The ASIC E1102 is a one-chip semiconductor integrated circuit incorporating a processing unit, and outputs the motor control signal E1106, the power supply control signal E1024, the power supply unit control signal E4000 and the like, which are described above. Moreover, the ASIC E1102 transmits and receives signals to/from the host I/F E0017, and transmits and receives signals to/from the device I/F E0100 on the front panel by use of the panel signal E0107. Moreover, by use of the sensor signal E0104, the ASIC E1102 controls sensors of the respective portions, such as the PE sensor and the ASF sensor, and detects the states thereof. In addition, by use of the multisensor signal E4003, the ASIC E1102 controls the multisensor E3000 and detects the state thereof. Furthermore, the ASIC E1102 detects the state of the panel signal E0107, and controls the driving of the panel signal E0107 to cause the LED E0020 on the front panel to blink.

Additionally, the ASIC E1102 detects a state of the encoder signal (ENC) E1020 to generate a timing signal, and establishes an interface with the printing head H1001 by use of the head control signal E1021. Thereby, a printing operation is controlled. The encoder signal (ENC) E1020 is an output signal of the encoder sensor E0004 which is inputted via the CRFFC E0012. The head control signal E1021 is inputted to the carriage substrate E0013 via the flexible flat cable E0012, and then is supplied to the printing head H1001 through the head-driving voltage modulation circuit E3001 and the head connector E0101 described above. Various kinds of information from the printing head H1001 are transmitted to the ASIC E1102. For one of these pieces of information that concerns the head temperature of each ejection portion, a signal is amplified with a head temperature detection circuit E3002 on the main substrate, and then is inputted to the ASIC E1102. Thereafter, the inputted signals are used to make decisions on various kinds of control.

In FIG. 8, E3007 denotes a DRAM, which is used as a buffer for printing data, a buffer for data received from the host computer and the like, and which is also used as a work area necessary for various kinds of control operations.

4. Recovery Operation

Recovery operations executed in this embodiment include, in addition to the aforementioned suction recovery operation by the suction recovery means, pre-ejection in which ink not contributing to printing is ejected from a printing head, and a wiping recovery operation in which the aforementioned cleaning means is used.

The pre-ejection is a recovery operation performed before and after the start of a printing operation, and during the printing operation, and is performed by driving ejection-energy generating elements (electrothermal transducers in this event) for ejecting ink, and thereby ejecting ink mainly into the caps 4A and 4B. For example, in a cap-open state in which the caps 4A and 4B are removed from the heads 1A and 1B, ink is ejected from the ejection orifices 1A*a* and 1B*b* of the printing heads 1A and 1B toward the ink-absorbing members 9A and 9B in the caps 4A and 4B.

This pre-ejection is a recovery operation for preventing ink in the ejection orifice portions 1A*a* and 1B*b* from thickening and solidifying during printing, and is usually performed at predetermined time intervals. Incidentally, this pre-ejection may be performed toward an unillustrated pre-ejection receiver provided independently of the caps 4A and 4B. This pre-ejection receiver can be formed of a container, an ink-absorbing member or the like.

The wiping recovery operation is a recovery operation in which substances adhering to the ejection-orifice formation surfaces of the printing heads 1A and 1B are wiped with the wipers 10A and 10B, respectively. In this embodiment, wet wiping is performed in which the ejection-orifice formation surfaces are wiped by dispensing wet fluid onto the wipers 10A and 10B.

Hereinafter, this recovery operation by wet wiping will be described with reference to the flowchart of FIG. 9. It should be noted that the following recovery operation control is performed with functions including calculation, decision and control by the ASIC E1102 and the like of the control system shown in FIGS. 7 and 8.

Here, the initial state of the inkjet printing apparatus in a power-off mode or in a standby mode will be described first. The recovery device 35 in the initial state is shown in FIG. 3. In this state, the caps 4A and 4B cover the ejection orifices 1A*a* and 1B*a* of the printing heads 1A and 1B, respectively. This prevents dust from adhering to the ejection-orifice formation surfaces of the printing heads 1A and 1B, and prevents ink from evaporating from the ejection orifices 1A*a* and 1B*a*.

Next, when power is turned on and a printing operation start signal is received, the caps 4A and 4B move (move down) in the direction indicated by arrow C. As a result, the caps 4A and 4B are respectively removed from the ejection-orifice formation surfaces of the printing heads 1A and 1B as shown in FIG. 4, and thus are brought into a cap-open state. This allows the carriage 2 to be moved, and thereby to perform a printing operation. In this print-ready state, wet wiping described below is carried out.

Figure 9:
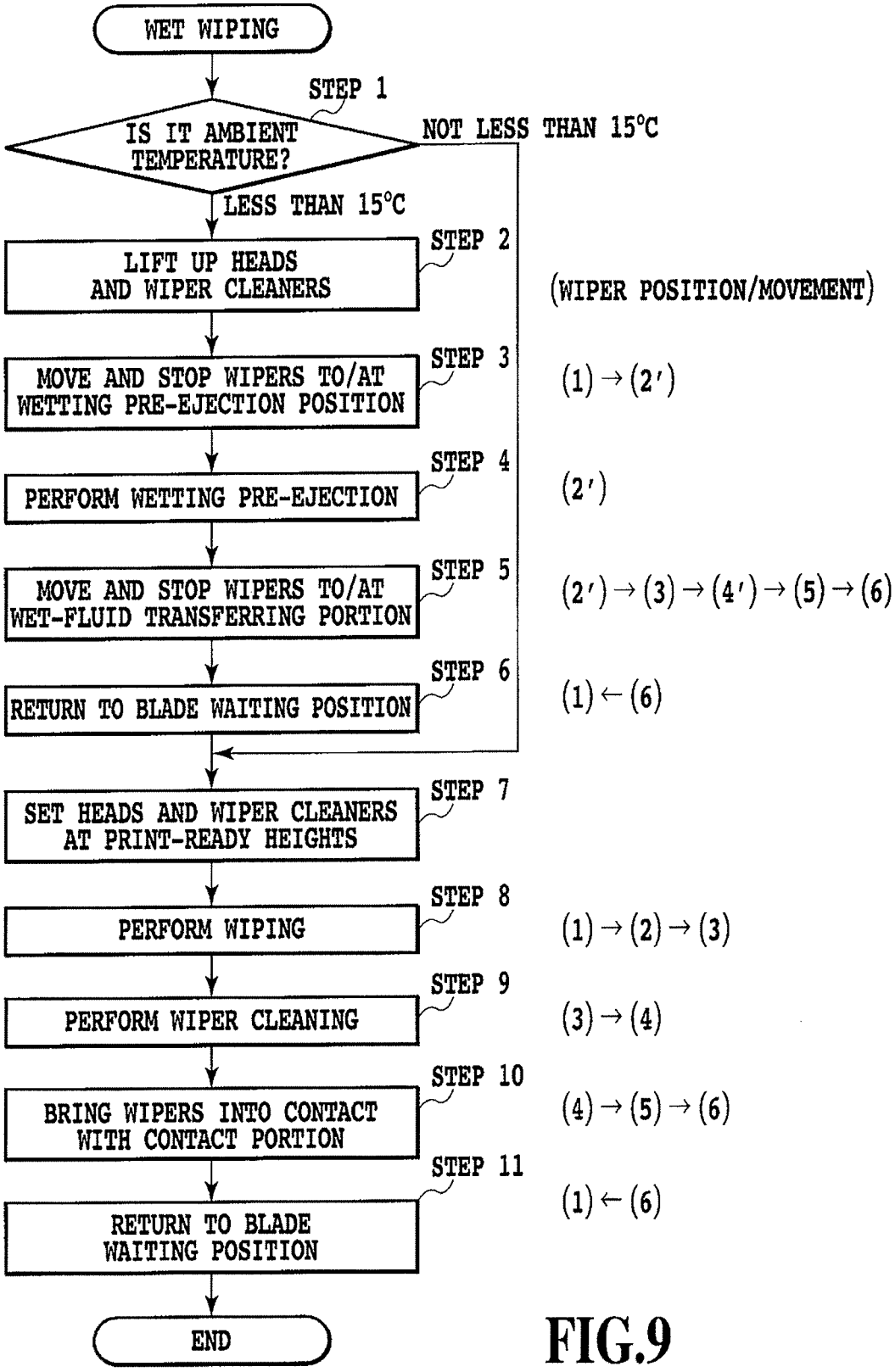
FIG. 9 is a flowchart showing an operation of controlling wet wiping in the first embodiment of the present invention.

FIG. 9 is a flowchart showing the operation procedure of wet wiping carried out in this embodiment. In step 1 of FIG. 9, the ambient temperature in the recovery device 35 is detected on the basis of the temperature detected by the temperature detector 36. Here, if the detected temperature is not less than 15° C., normal wet wiping of steps 7 to 11 is performed. On the other hand, if the detected temperature is less than 15° C., it is determined that the environment is a low-temperature environment. On the basis of the result of the determination, an operation specific to this embodiment is executed in steps 1 to 6, and then normal wet wiping is performed.

Here, the normal wet wiping will be initially described with reference to steps 7 to 11.

In a normal wet-wiping operation, the printing heads 1A and 1B and the wiper cleaners 11A and 11B are set at such heights (see FIG. 4) that printing can be performed on a printing medium (step 7). At this time, the wipers 10A and 10B are at the waiting position denoted by (1) in FIG. 4.

Subsequently, the wipers 10A and 10B move from the waiting position in the direction of arrow D, and move while rubbing the ejection-orifice formation surfaces including the ejection orifice portions 1A*a* and 1B*a* as denoted by (2). Then, the wipers 10A and 10B reach the position denoted by (3). During this period, the ejection-orifice formation surfaces are cleaned (step 8). Note that, during this period in which the wipers 10A and 10B are moving from (1) to (3), the caps 4A and 4B of the capping means are moved (moved down) in the direction of arrow C by unillustrated driving means. Thus, interference between the wipers 10A and 10B and the caps 4A and 4B is avoided.

After the cleaning of the ejection-orifice formation surfaces is finished, the wipers 10A and 10B further move in the direction of arrow D, and move while rubbing the wiper cleaners 11A and 11B as denoted by (4) in FIG. 4. This rubbing movement causes ink droplets, waste, dust, paper powder and the like adhering to the wipers 10A and 10B to be transferred to the corresponding wiper cleaners 11A and 11B. Thereby, the surfaces of the wipers 10A and 10B are cleaned (step 9).

Thereafter, the wipers 10A and 10B further move in the D-direction, pass a position (5), and come in contact with the contact portion 21*a* of the wet-fluid transferring member 21, where the wipers 10A and 10B stop for a predetermined time (step 10). During this stopping period, wet fluid moves from the contact portion 21*a* of the wet-fluid transferring member 21 to the wipers 10A and 10B. The movement of wet fluid from the contact portion 21*a* to the wipers and the adhering of wet fluid to the wipers are hereinafter referred to as a "transfer of wet fluid".

After the transfer of wet fluid, the wipers 10A and 10B turn back in the direction indicated by arrow E from the position (6) where the wipers 10A and 10B come in contact with the contact portion 21*a*, and then return to the waiting position (1). In this returning operation, the wiper cleaners 11A and 11B are lifted up and retracted by an unillustrated mechanism. The carriage 2 also moves in the main scanning direction (the X-direction) from the home position (wipeable position) where the carriage 2 faces the wipers 10A and 10B. Accordingly, contact between the carriage 2 and wipers 10A and 10B is avoided. That is, the ejection-orifice formation surfaces of the printing heads 1A and 1B are prevented from being wiped by the wiping surfaces (surfaces to which wet fluid is not transferred) of the wipers 10A and 10B for wiping the printing heads.

In the above-described normal wiping operation, when wiping is performed for the first time, the ejection-orifice formation surfaces of the printing heads are wiped in a state in which wet fluid is not transferred to the wipers. However, in a normal wiping operation thereafter, wet wiping is performed. That is, wet fluid transferred to the wipers in the first wiping operation is used in the next wet wiping. Here, with a property that it hardly evaporates, the wet fluid remains without being evaporated at the time of the next wiping. In addition, the wet fluid has much higher viscosity than inks used in ordinary inkjet printing apparatuses, and thus does not flow away after being transferred to the wipers. Incidentally, though the first wiping is dry wiping in which wet fluid is not used, changes in the states of the ejection-orifice formation surfaces due to this one-time dry wiping are negligible, considering the number of wiping operations performed during the endurance period of the apparatus.

Next, descriptions will be provided for an operation performed in a case where it is determined in the aforementioned step 1 that the environment is a low-temperature environment (less than 15° C.).

In this embodiment, only in the case where the temperature detected by the temperature detector 36 is a low temperature, an operation is performed in which the wipers 10A and 10B are wetted with ejected ink, and in which the ink is supplied to the wet-fluid transferring member 21.

That is, in step 2, as shown in FIG. 5, the printing heads 1A and 1B and the wiper cleaners 11A and 11B are initially lifted up to such heights that they do not interfere with the wipers 1A and 1B. This lifting-up is performed by an unillustrated lifting mechanism for moving up and down the carriage 2.

Thereafter, the wipers 10A and 10B move from the waiting position denoted by (1) in FIG. 5 to a position (2') under the ejection-orifice formation surfaces of the printing heads 1A and 1B, and then stop (step 3). In this state, the printing heads eject ink toward the wipers to wet the wipers 10A and 10B with the ink (step 4). This operation is hereinafter referred to as wetting pre-ejection. After this wetting pre-ejection, the wipers 10A and 10B move in the order of (3), (4') and (5), pass under the wiper cleaners 11A and 11B, and reach the position denoted by (6). As a result, the wipers 10A and 10B come in contact with the contact portion 21*a* of the wet fluid transferring portion 21 of the wet-fluid holding portion 19, and then stop for a predetermined time (step 5). During this contacting period, ink adhering to the wipers 10A and 10B are supplied to the contact portion 21*a*. This state is shown in FIG. 6.

Figure 6:
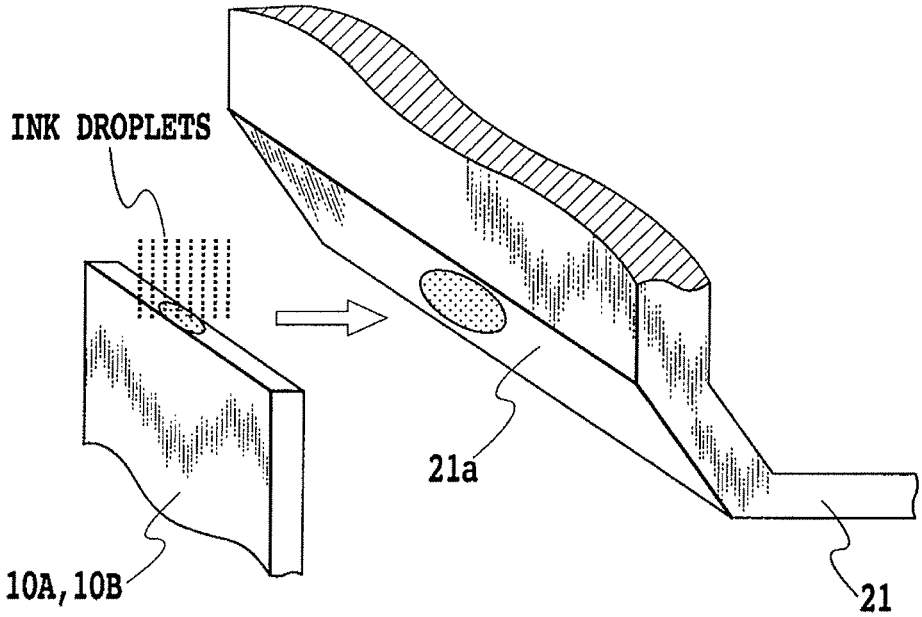
FIG. 6 is a perspective view schematically showing a state in which ink is supplied to a wet-fluid transferring member of the recovery device in an embodiment of the present invention.

As shown in FIG. 6, the ink supplied to the contact portion 21*a* of the wet-fluid transferring member 21 diffuses in the wet-fluid transferring member 21, and spreads wider than the diameters of the ink droplets adhering to the wipers 10A and 10B to decrease the viscosity of the surrounding wet fluid. Thereby, the amounts of wet fluid transferred from the wet-fluid transferring member 21 to the wipers 10A and 10B are greatly increased compared to those for a case where the viscosity is increased.

Subsequently, the wipers 10A and 10B move from the contact portion 21*a* where the wipers 10A and 10B are in contact with the wet-fluid transferring member 21, to the waiting position (step 6). In step 7, the printing heads 1A and 1B and the wiper cleaners 11A and 11B move (move down) to print-ready positions. To be more specific, the operation of the lifting mechanism lowers the printing heads 1A and 1B and the wiper cleaners 11A and 11B down to the positions shown in FIG. 4. Thereafter, the aforementioned wet wiping operation is performed by the aforementioned steps 8 to 11.

As described above, in this embodiment, even in a low-temperature environment, the ejection-orifice formation surfaces are wiped while wet fluid is sufficiently transferred to the wipers 10A and 10B. Accordingly, foreign substances adhering to the ejection-orifice formation surfaces are wiped with the wipers 10A and 10B while being dissolved in wet fluid. Hence, the foreign substances are reliably removed from the ejection-orifice formation surfaces. Since wet fluid existing between the wipers 10A and 10B and the ejection-orifice formation surfaces functions as a lubricant at the time of wiping, a smooth wiping operation is achieved. Moreover, thin films of wet fluid are formed on the ejection-orifice formation surfaces, and function as protective films for the ejection-orifice formation surfaces.

Thus, according to this embodiment, it is made possible to reduce changes (deteriorations in water repellency) in states of the ejection-orifice formation surfaces of the heads due to wiping, and favorable landing accuracy of ink droplets can be ensured even in later phases of the endurance periods of the printing heads. Accordingly, it is made possible to continuously maintain initial image quality.

It should be noted that, however, in this embodiment, ink is ejected toward the wipers in order to dispense ink to the wipers. Accordingly, the problem in conventional ink wet wiping that portions in the vicinities of the wipers are stained with ink is not completely solved. However, in this embodiment, the wipers are wetted with ink only when necessary depending on the ambient temperature. Thus, stains in the vicinity of the wiping device are greatly reduced compared to those for a case of conventional ink wet wiping, and the durability of the wiping device is greatly improved.

Incidentally, the above-described wet wiping operation can be performed with such a timing as conventionally used. For example, in a case where the cap-open state of the printing heads continues for a predetermined time, a wiping operation is conventionally performed in order to prevent the ejection-orifice formation surfaces from drying. Similarly, in this embodiment, it is also possible to carry out wet wiping depending on the duration of the cap-open state. Moreover, in order to resolve a situation in which the ejection orifice surfaces are stained with ink mist, the following operations are also conventionally carried out. Specifically, the number of ejection dots is counted, and a wiping operation is performed at the time when the counted value reaches a predetermined value or more. In this embodiment as well, wet wiping can be performed depending on the number of ink droplets ejected.

It is also effective to perform wet wiping before capping. Furthermore, since a relatively large amount of ink adheres to the ejection-orifice formation surfaces after a suction recovery operation, it is also desirable that wet wiping of this embodiment be performed after suction recovery or pre-ejection.

5. Results of Measuring Viscosity and Transferred Amount of Wet Fluid

Next, the following descriptions will show results of measuring the viscosity and the amount of wet fluid transferred to the wipers 10A and 10B at the time when the aforementioned wetting pre-ejection and wet wiping were carried out in a low-temperature environment.

In this embodiment, wetting pre-ejection and wet wiping were carried out under the conditions shown in the following Table 1.

TABLE 1

| | (Unit) |
|---|---|
| Wiper Width Directly under Nozzles | 1.5 mm |
| Nozzle Density | 1200 dpi Equivalent |
| Nozzle Spacing | 0.12 mm |
| Number of Nozzles Corresponding to Wiper Width | 71 nozzle |
| Amount of Ejected Ink Droplets | 3 pl |
| Number of Ejections of Wiper-Wetting Pre-Ejection | 2000 shot |
| Amount of Ink Supplied to Wipers | 0.43 μl ($mm^3$) |

In this measurement, each of the wipers 10A and 10B was made of polyether urethane having a width (thickness) of 1.5 mm. Accordingly, when the printing heads 1A and 1B having nozzle arrangement density of 1200 dpi are supposedly used, and when the amount of ejected ink droplet and the number of ejections of wetting pre-ejection are supposed to be respectively set at 3 pl and 2000, 0.43 $mm^3$ of ink is accumulated on the edges of the wipers 10A and 10B. Since the frequency of pre-ejection was substantially set at 6 kHz, wetting pre-ejection took approximately 0.33 seconds.

Because of the mechanical accuracy in stopping positions of the wipers 10A and 10B, the number of nozzles which actually perform wetting pre-ejection was set at 200, instead of 71 which corresponds to the wiper width (thickness). This is because the stopping position accuracy with which the moving mechanism stops the wipers 10A and 10B was estimated at approximately ±1.5 mm. Such adjustment is appropriately set according to the stopping position accuracy of the wiper-moving mechanism.

After ink was dispensed to the wipers 10A and 10B by wetting pre-ejection as shown in Table 1, the wipers 10A and 10B were moved in the order of (3), (5) and (6) shown in FIG. 5, and the aforementioned 0.43 $mm^3$ of ink was supplied to the contact portion 21*a* of the wet-fluid transferring member 21. This ink-supplied state is shown in FIG. 6. Depending on the composition of ink, ink used in inkjet printing apparatuses normally contains approximately 60 to 80% water. Accordingly, the contact portion 21*a* of the wet-fluid transferring member 21 supplied with ink through the wipers 10A and 10B is brought into a state near an aqueous glycerin solution, though only in the vicinity of the contact portion 21*a*. The following Table 2 shows results of measuring the viscosity of wet fluid at different temperatures at the time when a state of the wet fluid changed from containing 100% glycerin to being an aqueous glycerin solution.

TABLE 2

| Viscosity of Glycerin/Aqueous Glycerin Solution | | | |
|---|---|---|---|
| | Ambient Temperature | | |
| Gly:Water Ratio | 5° C. | 15° C. | 25° C. |
| 100:0 | Approximately 7500 cp | Approximately 2400 cp | Approximately 800 cp |
| 98:2 | Approximately 4200 cp | Approximately 1400 cp | Approximately 480 cp |
| 95:5 | Approximately 2200 cp | Approximately 800 cp | Approximately 200 cp |

As shown in Table 2, the viscosity of glycerin (Gly) in a low-temperature environment was drastically decreased by a slight increase in the water proportion. Accordingly, by supplying ejected ink to the contact portion 21*a* of the wet-fluid transferring member 21 via the wipers 10A and 10B, the viscosity of wet fluid in the vicinity of the contact portion 21*a* can be greatly decreased.

Here, it is supposed that 50% of water in 0.43 $mm^3$ of ink dispensed to the wipers 10A and 10B described above is supplied to the contact portion 21*a* of the wet-fluid transferring member 21, and that a 95% aqueous glycerin solution is thus obtained. In this case, the volume thereof is 4.3 $mm^3$. The penetrating depth of the supplied ink is unknown, but is supposed to be 0.5 mm, and the porosity of Sunfine (trademark) AQ900 constituting the wet-fluid transferring member 21 is supposed to be approximately 50%. In this case, it is considered that a 95% aqueous glycerin solution is generated in a portion having a diameter of approximately 5 mm with the center thereof being where the ink has been supplied.

Specifically, as shown in the schematic diagram of FIG. 6, ink supplied to the wet-fluid transferring member 21 diffuses in the wet-fluid transferring member 21, and the diffusion range thereof is made larger than the adhering range of ink on the wipers 10A and 10B. Then, the viscosity of wet fluid is decreased in the diffusion range of ink in the wet-fluid transferring member 21. Accordingly, in a case where ink is supplied to the wet-fluid transferring member 21, wet fluid is transferred to the wipers 10A and 10B from a wider range than that in a case where the viscosity of wet fluid is increased. It is considered that this increases the amount of wet fluid supplied to the wipers 10A and 10B.

As described above, by performing wetting pre-ejection in a low-temperature environment to cause ink to adhere to the wipers 10A and 10B, and then by supplying the ink to the contact portion 21*a* of the wet-fluid transferring member 21, wet fluid can be prevented from being thickened in a low-temperature environment.

It has been experimentally revealed that preventing wet fluid from thickening by wetting pre-ejection in this way stabilizes (increases) the amounts of wet fluid transferred to the wipers 10A and 10B. Results of measurement in the experiment are shown in Table 3.

TABLE 3

| First Embodiment | | | |
|---|---|---|---|
| Temperature (° C.) | Wetting Pre-Ejection (Number of Ejections) | Amount of Transferred Wet Fluid (mg) *Experimental Value | Reference Example Amount of Transferred Wet Fluid without Present Control |
| 25° C. | Undone (Zero Ejections) | 1.1 mg | 1.1 mg |

TABLE 3-continued

| First Embodiment | | | |
|---|---|---|---|
| Temperature (° C.) | Wetting Pre-Ejection (Number of Ejections) | Amount of Transferred Wet Fluid (mg) *Experimental Value | Reference Example Amount of Transferred Wet Fluid without Present Control |
| 10° C. | Done (2000 Ejections) | 0.8 mg | 0.3 mg |

In the reference example shown in this Table 3, the amount of transferred wet fluid for the case where conventional wet wiping was used, is shown. As shown in this reference example, in the conventional technique, the amount of wet fluid transferred per operation at an ambient temperature of 25° C. was 1.1 mg. Moreover, in the conventional technique, when the ambient temperature was 10° C., the amount of transferred wet fluid was decreased to 0.3 mg.

On the other hand, in the case where the control operation of this embodiment was performed, when the ambient temperature was 25° C., the amount of transferred wet fluid was stabilized at 1.1 mg as in the conventional technique. In this case, wetting pre-ejection is not performed because the ambient temperature is high. When the ambient temperature is 10° C., the aforementioned wetting pre-ejection is performed. In this pre-ejection, 2000 ink droplet ejections were performed. As a result, it was made possible to suppress an increase in the viscosity of wet fluid in a low-temperature environment, and the amount of transferred wet fluid was 0.8 mg. That is, a transferred amount substantially that for room temperature was obtained.

As apparent from the above-described experimental results, by supplying ink caused to adhere to the wipers by wetting pre-ejection to the wet-fluid transferring member 21, sufficient amount of wet fluid was transferred to the wipers 10A and 10B even in a low-temperature environment.

Second Embodiment

Next, a second embodiment of the present invention will be described.

In this second embodiment, supposing a case where the inkjet printing apparatus is left after the previous wetting pre-ejection is performed, only when the left-standing time exceeds a predetermined time, wetting pre-ejection is performed to supply ink to the wet-fluid transferring member 21.

Figure 10:
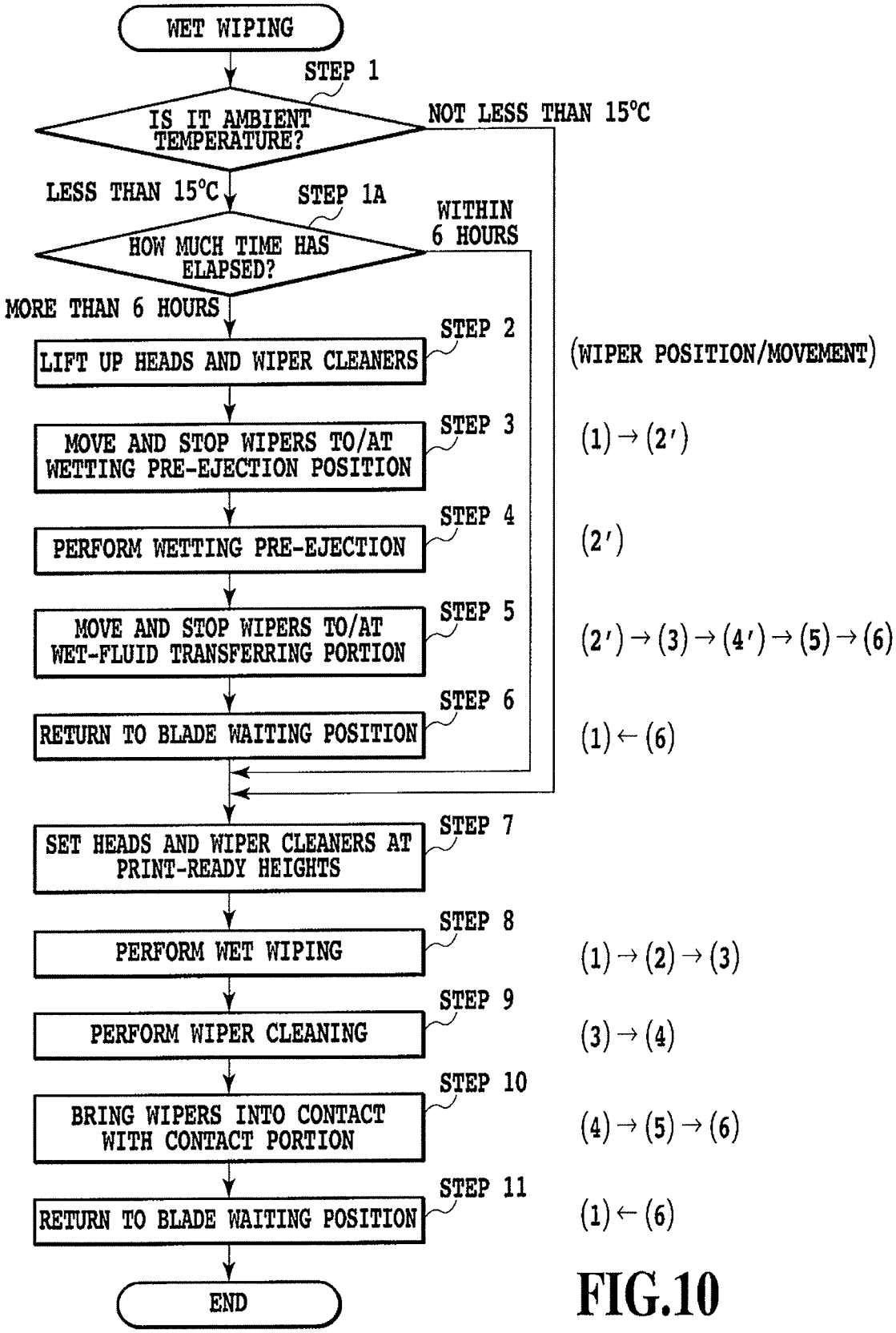
FIG. 10 is a flowchart showing an operation of controlling wet wiping in a second embodiment of the present invention.

That is, in this second embodiment, a control operation as shown in the flowchart of FIG. 10 is performed. Note that, in FIG. 10, steps, in which the same control operation as that in the flowchart shown in FIG. 9 is performed, are denoted by the same step numbers.

As shown in FIG. 10, in this second embodiment, the ambient temperature is first determined (step 1) as in the aforementioned first embodiment. Then, in the next step 1A, the time elapsed since the previous wetting pre-ejection has been executed, i.e., the time elapsed since ink has been last supplied to the transferring portion 21, is determined. As for the calculation of the elapsed time, in a case where the inkjet printing apparatus is provided with a battery such as a coin battery, the elapsed time can be counted up with a timer (time measuring means) which operates on the power source of the battery. Alternatively, it is also possible to find the elapsed time in the inkjet printing apparatus by using a timer command which can be obtained as header information of printing data.

In either case, when the time elapsed since the previous wetting pre-ejection is short (e.g., within six hours), the operation of steps 2 to 6 is not executed, and normal wet wiping is performed in steps 7 to 11. On the other hand, in a case where the environment is a low-temperature environment, and where the time elapsed since the previous wetting pre-ejection has been executed is not less than six hours, water in ink supplied to the wet-fluid transferring member 21 by the previous wiping may have possibly evaporated. Accordingly, wetting pre-ejection is again executed in steps 2 to 4 to wet the wipers 10A and 10B, and then ink dispensed to the wipers 10A and 10B in steps 5 and 6 is supplied to the wet-fluid transferring member 21.

According to this second embodiment, the number of times of wetting pre-ejection can be further reduced as compared to that of the aforementioned first embodiment. Accordingly, it is made possible to reduce the consumption of ink, and to further reduce stains in the vicinity of the wiping device.

Third Embodiment

Next, a third embodiment of the present invention will be described.

In this third embodiment, the number of ejections of wetting pre-ejection is changed according to the ambient temperature. This can further reduce the consumption of ink as compared to the aforementioned first and second embodiments, as shown in the following Table 4.

TABLE 4

| Third Embodiment | | | |
|---|---|---|---|
| Temperature (° C.) | Wetting Pre-Ejection (Number of Ejections) | Amount of Transferred Wet Fluid (mg) *Experimental Value | Reference Example Amount of Transferred Wet Fluid without Present Control |
| 20° C. or more | Undone (Zero Ejections) | 1.1 mg | 1.1 mg (25° C.) |
| 15 to 20° C. | Undone (Zero Ejections) | 0.8 mg | 0.8 mg (20° C.) |
| 10 to 15° C. | Done (1000 Ejections) | 0.7 mg | 0.5 mg (15° C.) |
| 10° C. or less | Done (2000 Ejections) | 0.8 mg | 0.3 mg (10° C.) |

As shown in Table 4, in this third embodiment, the control temperature range is fragmented, and control is performed so that the number of ejections of wetting pre-ejection increases as the ambient temperature decreases. That is, it can be considered that the control temperature range in Table 1 of the first embodiment is fragmented. In this third embodiment, the execution of wetting pre-ejection, the supply of ink dispensed to the wipers and a wet wiping operation are performed as in the first or second embodiment. In other words, this third embodiment differs from the aforementioned embodiments only in that the number of ejections of pre-ejection is controlled according to temperature.

In the reference example shown in Table 4, the amounts of wet fluid transferred per wiping operation for a case where wetting pre-ejection was not performed, and where wet wiping was performed at different ambient temperatures are shown. On the other hand, in this embodiment shown in Table 4, shown are the number of ink droplet ejections in wetting pre-ejection which was set for each ambient temperature, and the amount of wet fluid transferred to the wipers 10A and 10B at the time when the ink ejected at the time of the pre-ejection was supplied to the wet-fluid transferring portion.

In this third embodiment, in a case where the ambient temperature is 15° C. to 10° C., the number of ink droplet ejections in wetting pre-ejection is set half (1000) of the number of ejections in the first embodiment. Accordingly, the amount of transferred wet fluid is slightly less than that of the first embodiment. However, in consideration of frequency and the like at which the inkjet printing apparatus is used in such an environment, it can be said that an obtained amount of transferred wet fluid is at a substantially acceptable level. Moreover, since the number of ink droplet ejections in wetting pre-ejection is smaller than that of the first embodiment, stains in the vicinities of the wipers 10A and 10B and the wiping device are reduced as compared to those of the first embodiment.

As described above, by fragmenting the ambient temperature range, and by optimizing the number of ejections in wetting pre-ejection for each temperature, it is made possible to further reduce the consumption of ink, and to further reduce stains in the vicinities of the wipers and of the wiping device.

Fourth Embodiment

Next, a fourth embodiment of the present invention will be described.

In this fourth embodiment, the color of ink used to perform wetting pre-ejection is limited. An object of this embodiment is to maintain the water-repelling performance of printing heads (water-repellent heads) in which water-repellent treatment has been performed on the ejection-orifice formation surfaces, i.e., maintain the printing heads to be not easily wetted.

In the aforementioned first to third embodiments, wetting pre-ejection is performed for inks of all colors. However, some inks easily spread on the ejection-orifice formation surfaces, and other inks do not easily spread. For example, as a so-called matte black ink ejected with the black head 1A, self-dispersing pigmented ink is used here. For this matte black ink, an employed dispersing method is different from those of other resin pigmented inks ejected with the color heads 1B. Accordingly, there are cases where wettability is different. Moreover, there is no guarantee that inks of three colors of cyan, magenta and yellow which are ejected from the color heads 1B have equivalent wettability. In particular, in a case where the kind of resin changed from one to another in order to ensure the stability of pigment dispersion, or where ink formulae are varied depending on colors for various reasons, there are cases where inks have differences in wettability is different depending on inks.

Even in such cases, if each ink is supplied to the wet-fluid transferring member 21 by wetting pre-ejection, the effect of decreasing the viscosity of wet fluid is expected. However, next time wet fluid is transferred, there are cases where spreadable ink dispensed to the wet-fluid transferring member 21 is reversely transferred from the wet-fluid transferring member 21 to the wipers 10A and 10B. In such a case, wiping is performed in an unfavorable state in the next wiping.

In view of this, in this fourth embodiment, ink used for performing wetting pre-ejection is limited to ink having such a composition that the ink does not easily spread on the ejection-orifice formation surface. Alternatively, the ink maybe limited to that having a low pigment concentration. This is because pigmented ink generally has a characteristic that the ink does not easily spread on the ejection-orifice formation surfaces if the pigment concentration is lower.

In this fourth embodiment, since it has been revealed that matte black ink has a characteristic that it does not easily spread on the ejection-orifice formation surface as compared to other resin pigmented inks, the wiper 10A for the black head 10A is wetted with color ink, which is resin pigmented ink. Moreover, among color inks, cyan ink has the lowest pigment concentration. Accordingly, in this embodiment, the wiper 10A is wetted with cyan ink. This operation is performed with the following method. Specifically, the wiper 10B for wiping the color heads 1B is initially wetted with ink ejected from the respective color heads 1B. Then, the carriage 2 is moved in the main scanning direction (the X-direction in FIG. 2), and then is positioned directly above the printing head 1B which ejects cyan ink. This position control on the printing head can be performed on the basis of a signal from a known encoder sensor (not shown) used in a printing operation. Thereafter, by ejecting cyan ink, the cyan ink is dispensed to the wiper 10A.

Moreover, by using the above-described method, it is made possible to wet each wiping position of the wiper 10B by using only cyan ink which does not easily spread. Further, depending on the compositions of inks, it is also possible to wet each wiping position of the wipers 10A and 10B by using ink other than cyan. Thus, ink used in wetting pre-ejection can be appropriately selected.

As described above, according to this fourth embodiment, since the wipers are wetted using only inks, which does not easily spread on the ejection-orifice formation surfaces, it is made possible to maintain the water-repellency of the ejection-orifice formation surfaces over a long period of time. Thus, more stable ink ejection can be performed.

Incidentally, the case where water-repellent treatment is performed on the ejection-orifice formation surfaces in order to stabilize the ejection performance of the printing heads has been taken as an example in the above description. However, hydrophilic treatment may be performed on the ejection-orifice formation surfaces in order to maintain the wettability of the ejection-orifice formation surfaces to be even. In a case where printing heads, in which hydrophilic treatment is performed on the ejection-orifice formation surfaces, are used, wetting pre-ejection is performed using ink which easily spreads, contrary to the above example. In this case as well, ink used in wetting pre-ejection can also be selected by using the above-described method in which the carriage is moved.

Fifth Embodiment

Next, a fifth embodiment of the present invention will be described.

In this fifth embodiment, when wetting pre-ejection is performed, the wipers 10A and 10B are wetted without lifting up the carriage 2. With regard to control operation, step 2 of FIGS. 9 and 10 executed in the aforementioned first and third embodiments is omitted, and the carriage 2 is always held at such a height that printing can be performed. Accordingly, wetting pre-ejection is performed in a state where the wipers 10A and 10B are bent as wiping the heads as in a normal wiping operation.

This fifth embodiment eliminates the need for a mechanism for moving the carriage 2 up and down, and makes cost reduction and miniaturization of the apparatus possible. It should be noted that, however, a mechanism for moving the wiper cleaners 11A and 11B up and down is needed, and that a simple mechanism needs to be additionally provided. To lift up the carriage 2, the guide shafts 3 for the carriage 2 usually need to be lifted up. For this reason, a high accuracy and a complicated configuration are required for a lifting mechanism. Accordingly, if a mechanism for moving the carriage 2 up and down can be omitted, it is made possible to greatly reduce costs, and the effect thereof is enormous.

It should be noted that, however, in this fifth embodiment, since ink is dispensed to the wipers 10A and 10B being bent as wiping the ejection-orifice formation surfaces, ink tends to be accumulated on wall portions below tip portions of the wipers 10A and 10B, and the amounts of ink dispensed to the tip portions are slightly decreased. Meanwhile, the tip portions of the wipers 10A and 10B come in contact with the contact portion 21*a* of the wet-fluid transferring member 21. For this reason, the amounts of wet fluid transferred from the wet-fluid transferring member 21 to the wipers tend to decrease due to a decrease in the amounts of ink dispensed to the tip portions of the wipers.

In actual cases, whether or not to employ a method in which the printing heads 2 are lifted up can be determined in consideration of costs, the size of the inkjet printing apparatus, the degree to which each ink spreads on the ejection-orifice formation surfaces, the product life including stains made by ink, and the like.

In this fifth embodiment, as shown in step 3 of FIG. 10, after the wipers 10A and 10B are stopped at a wetting pre-ejection position, wetting pre-ejection is performed. However, the wipers may be wetted by sequentially ejecting ink in accordance with the movement of the wipers. This prevents ink, which is ejected to the wipers, from scattering to the outside at the time of wetting pre-ejection, and makes it possible to reduce stains on the apparatus.

Sixth Embodiment

Next, a sixth embodiment of the present invention will be described.

Figure 11:
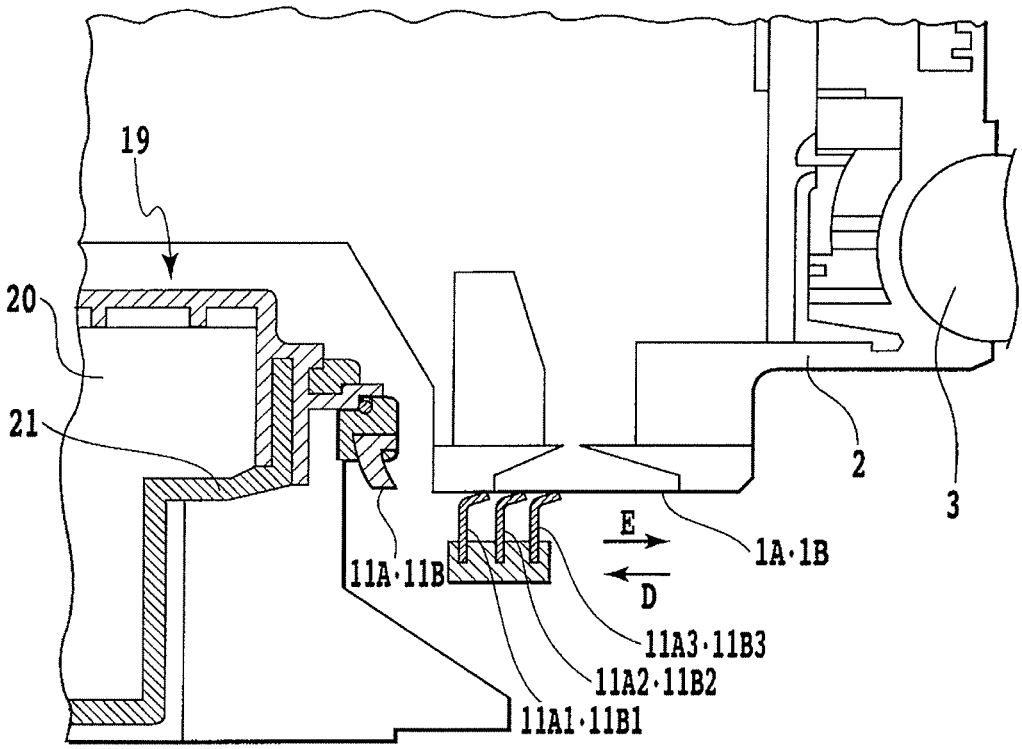
FIG. 11 is a side view showing a recovery device of a sixth embodiment of the present invention, showing a state thereof at the time when ejection-orifice formation surfaces are wiped.
Figure 12:
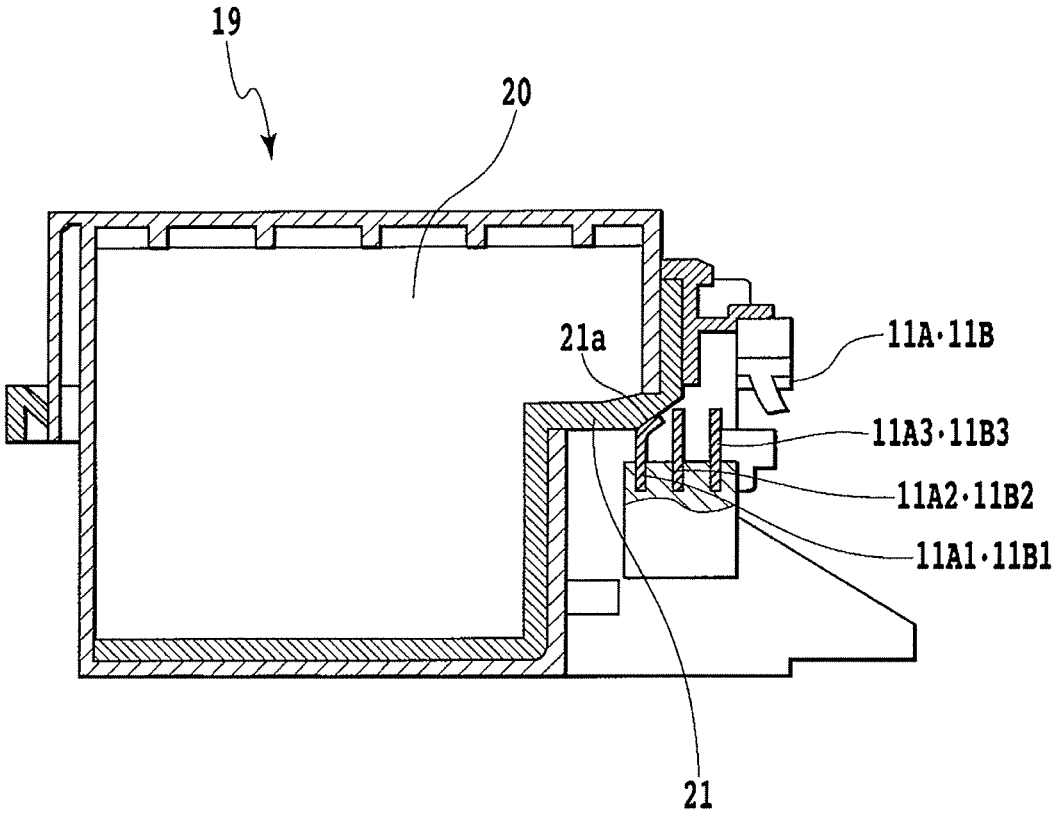
FIG. 12 is a side view showing the recovery device of the sixth embodiment of the present invention, showing a state thereof at the time when wet fluid is transferred.
Figure 13:
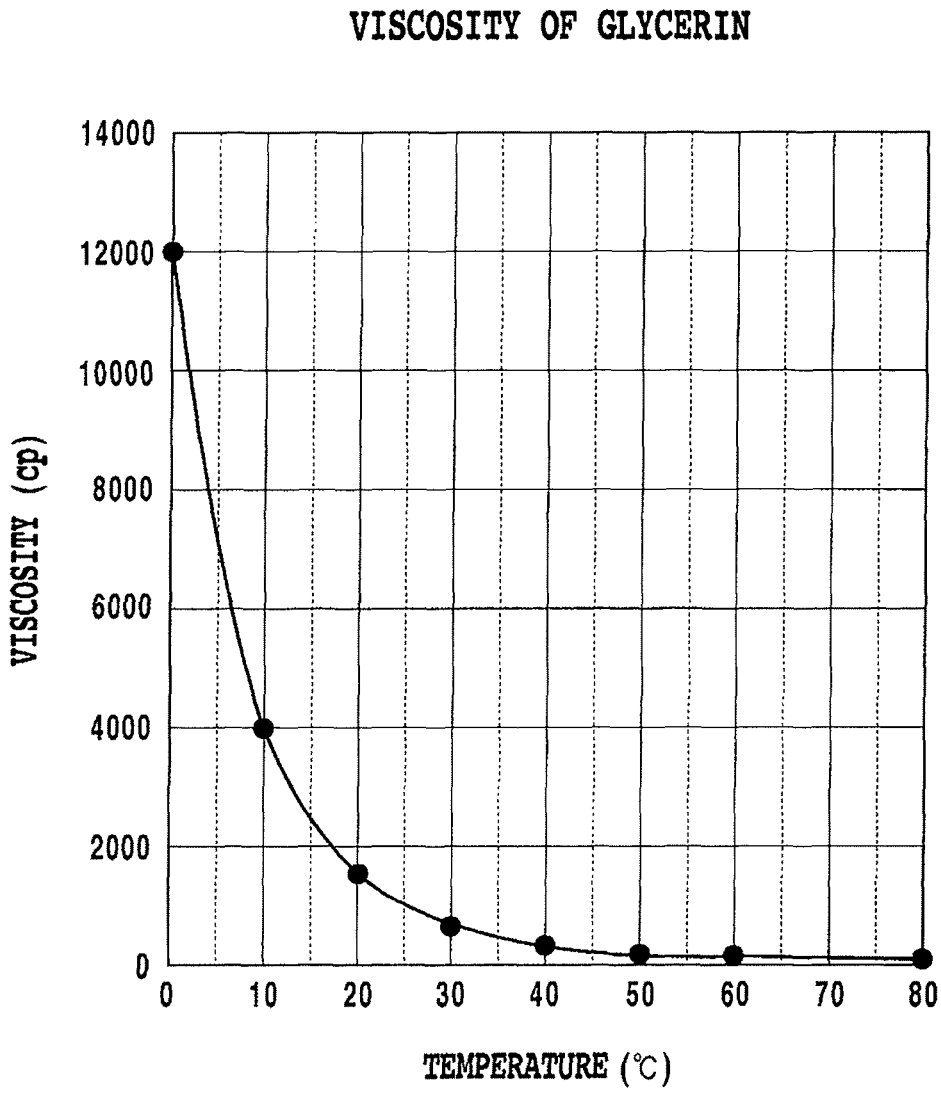
FIG. 13 is a view showing a temperature-viscosity curve for glycerin.

In this sixth embodiment, as shown in FIGS. 11 and 12, a plurality of wipers are arranged along the arranging direction (the Y-direction) of ejection orifices of the ejection orifices 1A*a* and 1B*b* of the printing heads 2. Here, for each of the ejection-orifice formation surfaces of the printing heads 1A and 1B, three wipers 10A1, 10A2, and 10A3, or 10B1, 10B2, and 10B3 are placed with a predetermined spacing along the arranging direction of the ejection orifices. Among the wipers, each pair of wipers 10A1 and 10B1, 10A2 and 10B2, and 10A3 and 10B3 have the same shapes, and are placed in the same positions in the arranging direction of the ejection orifices. Consequently, in this event, a description will be given by taking, as an example, the operation of the wipers 10Al to 10A3 positioned in the foreground of the drawing. It should be noted that other components are the same as those of the aforementioned embodiments, and that in FIGS. 11 and 12, portions equal or equivalent to those shown in FIG. 5 are denoted by the same reference numerals. Incidentally, suctioning means, such as caps, is not shown in these drawings.

The wipers 10A1, 10A2, and 10A3 in this sixth embodiment are held with one holding member, and simultaneously move in the same direction in a wiping operation. In the wiping operation, as in the aforementioned embodiments, wetting pre-ejection is performed in a low-temperature environment, and then wet wiping is performed. However, of the three wipers 10A1, 10A2, and 10A3, the wiper which performs wet wiping is only the first wiper 10A1 positioned in the leading position, and wet fluid is not transferred to the trailing wipers 10A1 and 10A3.

Specifically, after ink is dispensed to the first wiper 10A1 by wetting pre-ejection as in the aforementioned embodiments, the first wiper 10A1 comes in contact with the contact portion 21*a* of the wet-fluid transferring member 21 to supply the ink to the contact portion 21*a*. Then, in a state in which the trailing wipers 10A2 and 10A3 are not in contact with the wet-fluid transferring member 21, the wipers 10A1, 10A2, and 10A3 return to the waiting position. Hence, in a wiping operation for the ejection-orifice formation surface, the leading wiper with wet fluid transferred thereto moves while being in contact with the ejection-orifice formation surface, and thereby applies the wet fluid to the ejection-orifice formation surface. Thus, foreign substances such as thickened ink and dust adhering to the ejection-orifice formation surface are dissolved, and then the dissolved foreign substances are wiped with the trailing wipers 10A2 and 10A3. As described above, by performing the dissolving of foreign substances in wet fluid and the wiping of the foreign substances with different timings, the ejection-orifice formation surface can be more favorably cleaned. This wet wiping is similarly performed on the printing head 1B by using the wipers 10B1, 10B2 and 10B3.

In the above-described sixth embodiment, wet fluid is transferred only to the leading wiper, among the provided wipers, in the wiping direction. However, it is also possible to transfer wet fluid to all of the wipers. In this case, wetting pre-ejection performed in a low-temperature environment can be performed on all of the wipers, or only on the leading wiper. In other words, in a case where a plurality of wipers are used, wetting pre-ejection may be performed at least on the leading wiper in a low-temperature environment.

Other Embodiments

The present invention is not limited to the above-described embodiments. It is possible to appropriately change the materials of the wet fluid, of the wet-fluid holding portion, of the wet-fluid transferring member, and the like; the states, i.e., water-repellency, non-water-repellency, hydrophilicity or the like, of the ejection-orifice formation surfaces; and the like. Moreover, the surface tension of ink, the contact angle of ink with respect to the ejection-orifice formation surfaces and the like, which are indices of the wettability of ink, can also be varied. Thus, the aforementioned embodiments can be modified into various forms. Furthermore, though the case where pigmented ink is used is taken as an example in the present specification, the present invention can also be applied to dye ink.

Moreover, in the aforementioned embodiments, the ambient temperature around the recovery device is detected with the temperature detector in order to detect an environment in which wet fluid is thickened. However, wet fluid is also thickened due to a low-humidity environment. Accordingly, it is also possible to detect the humidity around the recovery device with a known humidity detector, and to transfer wet fluid according to the humidity. In addition, a transferring operation performed on the wipers may be controlled on the basis of both of the ambient temperature and the ambient humidity.

Furthermore, the present invention is not limited to a configuration in which the wipers reciprocate, such as described above. The present invention is also effective for an inkjet printing apparatus including a wet wiping mechanism using a rotary wiper, such as that described in the aforementioned Japanese Patent Laid-Open No. Hei 10-138502.

In the aforementioned embodiments, the returning position of the wipers 10A and 10B is set at the contact position 21*a* (the position denoted by (6)) between the wipers 10A and 10B and the wet-fluid transferring member 21. Accordingly, in all of wiping operations performed in the aforementioned embodiments, wet wiping is performed. However, it is also possible to selectively carry out wet wiping and dry wiping. For example, in the wiping movement path shown in FIG. 5, a second returning position is set between the positions denoted by (5) and (6), and the wipers 10A and 10B are caused to return from the second position to the waiting position (1). This makes it possible to selectively carry out wet wiping including the step (the step in which the wipers 10A and 10B move to the first turning position (6) and then return to the waiting position (1)) of transferring wet fluid and a dry wiping process not including wet fluid transfer. The present invention is also effective for a case of such a recovery device in which a plurality of wiping processes can be carried out.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese patent application No. 2006-152689, filed May. 31, 2006, which is hereby incorporated by reference herein in its entirety.

What is claimed is:

1. An inkjet printing apparatus, comprising:

a wiper for wiping an ejection-orifice formation surface of a printing head in which an ink-ejection orifice is formed;

a treatment-fluid holding portion which holds treatment fluid, and which comprises a transferring portion for transferring the treatment fluid to said wiper;

detecting means for detecting an ambient temperature in the inkjet printing apparatus; and control means that controls said wiper and the printing head, wherein said control means brings said wiper into contact with the transferring portion without ejecting ink from the printing head to said wiper when the ambient temperature detected by said detecting means is equal to or more than a predetermined temperature, wherein said control means brings said wiper into contact with the transferring portion after ejecting ink from the printing head to said wiper when the ambient temperature is lower than the predetermined temperature, and wherein said control means increases an amount of ink ejected from the printing head to said wiper as the ambient temperature decreases.

2. The inkjet printing apparatus according to claim 1, further comprising:

measuring means for measuring a time elapsed since the printing head has ejected the ink to said wiper, wherein said control means brings said wiper into contact with the transferring portion without ejecting ink from the print head to said wiper even if the temperature is lower than the predetermined temperature when the elapsed time measured by said measuring means is shorter than a predetermined period.

3. The inkjet printing apparatus according to claim 1, further comprising:

a plurality of printing heads for ejecting a plurality of kinds of ink, each printing head ejects one of the plurality of kinds of ink, to said wiper is one of the plurality of kinds of inks, and is suitable for making a wettability of the ejection-orifice formation surface uniform.

4. The inkjet printing apparatus according to claim 1, wherein the printing head includes an ejection-orifice formation surface on which water-repellent treatment is performed, and the ink ejected to said wiper is a type of ink which does not easily spread on the ejection-orifice formation surface.

5. The inkjet printing apparatus according to claim 1, wherein the treatment fluid is any one of single solvents and mixed solvents of polyhydric alcohols.

6. The inkjet printing apparatus according to claim 1, wherein said treatment-fluid holding portion is formed of any one of an absorber made of fibers and an open-cell foam, and transfers treatment fluid by being in contact with said wiper.

7. A method of wiping a printing head, in which an ejection-orifice formation surface of the printing head with an ink-ejection orifice formed therein is wiped by a wiper, the method comprising the steps of:

transferring treatment fluid to the wiper by bringing the wiper into contact with a transferring portion of a treatment-fluid holding portion which holds treatment fluid;

detecting an ambient temperature in the inkjet printing apparatus; and ejecting ink from the printing head to the wiper before the wiper is brought into contact with the transferring portion when the ambient temperature is lower than a predetermined temperature, wherein the printing head increases an amount of ink to eject to said wiper as the ambient temperature decreases.

* * * * *